US010675215B1

(12) United States Patent
Yoon et al.

(10) Patent No.: US 10,675,215 B1
(45) Date of Patent: Jun. 9, 2020

(54) ADJUSTABLE DEVICE FOR BODY AND MUSCLE THERAPY

(71) Applicants: Young Yoon, San Diego, CA (US); Tyler Forbes, Solana Beach, CA (US)

(72) Inventors: Young Yoon, San Diego, CA (US); Tyler Forbes, Solana Beach, CA (US)

( * ) Notice: Subject to any disclaimer, the term of this patent is extended or adjusted under 35 U.S.C. 154(b) by 928 days.

(21) Appl. No.: 15/251,436

(22) Filed: Aug. 30, 2016

Related U.S. Application Data

(60) Provisional application No. 62/211,799, filed on Aug. 30, 2015.

(51) Int. Cl.

| | |
|---|---|
| ***A61H 7/00*** | (2006.01) |
| ***A61H 39/04*** | (2006.01) |
| ***A61H 1/00*** | (2006.01) |
| *A61H 15/00* | (2006.01) |

(52) U.S. Cl.
CPC ..... *A61H 39/04* (2013.01); *A61H 1/008* (2013.01); *A61H 7/007* (2013.01); *A61H 2015/0042* (2013.01)

(58) Field of Classification Search
CPC ..... A61H 7/001; A61H 7/007; A61H 2201/1284; A61H 2201/1695; A61H 39/04; A61H 1/008
See application file for complete search history.

(56) References Cited

U.S. PATENT DOCUMENTS

| | | | | |
|---|---|---|---|---|
| 1,265,083 A | | 5/1918 | Hoard | |
| 3,831,592 A | | 8/1974 | Lancellotti | |
| 4,126,129 A | | 11/1978 | Rainbow | |
| 4,207,878 A | | 6/1980 | Duncan | |
| 4,233,966 A | * | 11/1980 | Takahashi | A61H 39/04 601/134 |
| 4,452,237 A | | 6/1984 | Lewis | |
| 5,096,188 A | * | 3/1992 | Shen | A61H 7/001 482/51 |
| 5,320,640 A | | 6/1994 | Riddle | |
| 5,570,703 A | | 11/1996 | Cooper | |
| 5,580,336 A | | 12/1996 | Coallier | |
| 5,590,992 A | | 1/1997 | Russell | |
| D387,871 S | | 12/1997 | Childs | |
| 5,843,005 A | * | 12/1998 | Chubinsky | A61H 7/003 601/15 |
| 5,887,589 A | | 3/1999 | Hogan | |
| 5,899,868 A | | 5/1999 | VandeBerg | |
| 5,913,839 A | | 6/1999 | Wincek | |
| 6,102,876 A | | 8/2000 | Winger | |

(Continued)

OTHER PUBLICATIONS

USPTO, Extended Office Action dated Sep. 5, 2019, re U.S. Appl. No. 15/445,932 / 04-003, 33 pgs.

*Primary Examiner* — Quang D Thanh
(74) *Attorney, Agent, or Firm* — Gaia Intellectual Properties, LLC

(57) ABSTRACT

A device for the treatment of discomfort or pain in the body and muscles. The position of one or more pressure members of a therapy device which make contact with one or more areas of the body may be adjusted finely, readily, and independently with respect to their distance to a support base and/or with respect to other pressure members. Exemplary embodiments can be configured for muscle relief therapy for areas such as the head, neck, shoulders, back, hips, legs and feet.

8 Claims, 23 Drawing Sheets

(56) References Cited

U.S. PATENT DOCUMENTS 6,217,121 B1 * 4/2001 Mollet ..... A47C 23/002 297/452.21
6,419,650 B1 7/2002 Ryan
6,821,260 B2 11/2004 Fors
6,878,124 B1 * 4/2005 Crowe ..... A61H 15/0092 601/119
7,223,251 B1 5/2007 Cassidy
7,320,668 B1 1/2008 Warder
7,458,945 B2 * 12/2008 Zemont ..... A61H 15/0092 601/131
8,496,007 B2 7/2013 Rambo et al.
8,932,322 B2 1/2015 Reynolds
10,364,556 B2 7/2019 Zavodnick
2002/0068888 A1 * 6/2002 Wang ..... A61H 7/002 601/136
2004/0147959 A1 * 7/2004 Shin ..... A61F 5/01 606/240
2004/0204742 A1 10/2004 Graham et al.
2004/0249325 A1 12/2004 Stultz
2007/0173750 A1 7/2007 Hudock
2007/0225627 A1 9/2007 Cox et al.
2007/0276438 A1 11/2007 Meglin
2008/0004553 A1 * 1/2008 Tsai ..... A61H 15/0092 601/120
2008/0139981 A1 6/2008 Walquist
2008/0248936 A1 10/2008 Ferriss et al.
2009/0012435 A1 1/2009 Masek
2009/0259152 A1 10/2009 Nguyen
2010/0191161 A1 * 7/2010 Mouatt ..... A61H 7/001 601/137
2010/0222721 A1 9/2010 Schwartz et al.
2011/0040219 A1 2/2011 Tanner et al.
2013/0237886 A1 9/2013 Gavoni
2014/0207035 A1 7/2014 Zimmerman
2014/0350443 A1 * 11/2014 Raines ..... A61H 15/0092 601/120
2016/0074273 A1 3/2016 Mallory

* cited by examiner

ADJUSTABLE DEVICE FOR BODY AND MUSCLE THERAPY

CROSS-REFERENCE TO RELATED APPLICATION

The present application claims the benefit of U.S. Provisional Patent Application No. 62/211,799, filed on Aug. 30, 2015, and titled, "ADJUSTABLE DEVICE FOR BODY AND MUSCLE THERAPY", the disclosure of which is expressly incorporated by reference in its entirety.

BACKGROUND

Field

Certain aspects of the present disclosure generally relate to physical therapy and massage devices, and more particularly to systems and methods for the relief or prevention of discomfort or pain in the body.

Background

There may be many ways to treat body or muscle discomfort. For example, medication, herbal treatments, acupuncture, chiropractic treatment, sauna/spa treatments, and/or physical therapy may be directed to the relief or prevention of discomfort or pain in the body. In some cases, physical therapy may involve the use of massage devices.

Massage therapy devices may target areas of the body where muscles may be tight. Such areas may be referred to as trigger points or knots. Massage devices may also be applied as part of a physical therapy that is directed to posture improvement and/or spine alignment. Areas of the body to which a massage device may be applied include muscles in and around the neck, shoulder, back, glutes, hips, legs and feet.

One class of therapy devices may apply pressure in a focused manner to one or multiple areas of the body. If such a therapy device may be used by a person without the aid of another person (e.g. therapist), it may be referred to as a self-treatment device. Some self-treatment devices may also be used with the aid of another person.

Therapeutic devices that apply pressure in a focused manner to the body may have one or more pressure members. For therapy devices with more than one pressure member, the combined shape of the pressure members that may come into contact with a body may be referred to as a contour. The shape of the contour may account for normal curvature of a back, for example, or for a typical height of a neck when a person is lying on a floor.

As the size and shape of a body many vary from person to person, it may be desirable for a therapy device to be adjustable. For current systems, however, adjustment of individual pressure members along multiple, independent dimensions remains a challenging problem.

Accordingly, aspects of the present disclosure are directed to methods to improve adjustable therapeutic devices. Aspects of the present disclosure may be directed to improving self-treatment devices which can apply pressure in a focused manner to one or multiple areas of the body.

SUMMARY OF THE INVENTION

The present disclosure provides adjustable therapy devices, and systems and methods for adjusting a therapy device. In some embodiments, a vertical height, which may be referred to as a z-direction, of a pressure member of a therapy device may be adjusted. In another embodiment, a therapy device may include multiple pressure members for which a horizontal location of a pressure member relative to other pressure members may be adjusted. According to certain aspects, multiple pressure members may be adjusted in a coordinated manner.

Certain aspects of the present disclosure provide an adjustable therapy device. The device generally includes a first pressure member; a base; and an adjustable spacing unit allowing controlled adjustment of a first distance from a first surface of the base to the first pressure member, the adjustable spacing unit having a first end attached to the base and having a second end attached to the first pressure member.

Certain aspects of the present disclosure provide an adjustable therapy device. The device generally includes a base; a plurality of pressure members, including a first, a second, and a third pressure member; a plurality of adjustable spacing units, including a first, a second, and a third spacing unit; wherein the first adjustable spacing unit allows controlled adjustment of a first distance from a first surface of the base to the first pressure member; wherein the second adjustable spacing unit allows controlled adjustment of a second distance from the first surface of the base to the second pressure member; and wherein the third adjustable spacing unit allows controlled adjustment of a third distance from the first surface of the base to the third pressure member; and means for adjusting a fourth distance from the second adjustable spacing unit to the third adjustable spacing unit.

BRIEF DESCRIPTION OF THE DRAWINGS

Various embodiments of the present disclosure are described. The components in the drawings are not necessarily to scale as emphasis is placed upon illustrating the principals of corresponding disclosure.

DETAILED DESCRIPTION

Figure 1A:
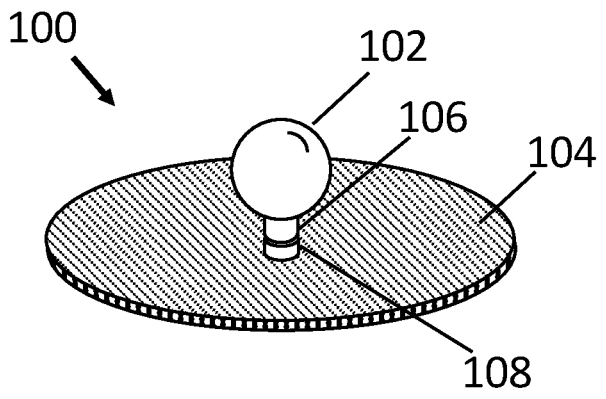
FIG. 1A illustrates a front perspective view of an example of an adjustable therapy device with a single pressure member in accordance with certain aspects of the present disclosure.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Based on the teachings, one skilled in the art should appreciate that the scope of the disclosure is intended to cover any aspect of the disclosure, whether implemented independently of or combined with any other aspect of the disclosure. For example, an apparatus may be implemented or a method may be practiced using any number of the aspects set forth. In addition, the scope of the disclosure is intended to cover such an apparatus or method practiced using other structure, functionality, or structure and functionality in addition to or other than the various aspects of the disclosure set forth. It should be understood that any aspect of the disclosure disclosed may be embodied by one or more elements of a claim.

The word "exemplary" is used herein to mean "serving as an example, instance, or illustration." Any aspect described herein as "exemplary" is not necessarily to be construed as preferred or advantageous over other aspects.

Although particular aspects are described herein, many variations and permutations of these aspects fall within the scope of the disclosure. Although some benefits and advantages of the preferred aspects are mentioned, the scope of the disclosure is not intended to be limited to particular benefits, uses or objectives. Rather, aspects of the disclosure are intended to be broadly applicable to different technologies and system configurations, some of which are illustrated by way of example in the figures and in the following description of the preferred aspects. The detailed description and drawings are merely illustrative of the disclosure rather than limiting, the scope of the disclosure being defined by the appended claims and equivalents thereof.

It must be noted that as used herein and in the appended claims, the singular forms "a", "an", and "the" include plural referents unless the context clearly dictates otherwise. Thus, for example, reference to "an object" includes a plurality of objects.

Limitations of Currently Available Therapy Devices

Some currently available therapy devices may not be adjustable. In one example, a therapy device may feature a contour that has been molded or cut from a material into a desired shape. In another example, a contour of a therapy device may be made of multiple pressure members that are configured in a particular, fixed contour. For such devices, it may not be possible for a user to adjust the contour.

Some currently available therapy devices may provide for a contour that may be adjusted through the use of an inflatable unit. For example, an inflatable unit may be inflated or deflated to increase or decrease the height of a therapy device. For such a device, the rigidity of the device may change as a function of the level of inflation of the inflatable unit. In this example, the adjustment of height may be considered coupled to the adjustment of pressure since the amount of pressure that may be provided by such a therapy device may change at different heights. It may not be possible, for example, for a user to adjust the device to a lower height and a higher pressure. Similarly, it may not be possible for a user to adjust the device to a lower height while maintaining the same pressure.

Furthermore, the shape of a contour of a therapy device that features an inflatable bladder may be coupled to the level of inflation, since the contour may change as a function of a level of inflation. The contour of a bladder-based system may expand, for example, as the inflatable member inflates, or retract as the inflatable member deflates. It may be desirable, however, for the shape and height of a contour to be independently adjustable. For example, a user may desire that one area of a therapeutic device (e.g. at a top left side) be adjusted higher and for a second area of the device (e.g. at a bottom right side) to be adjusted lower. It may not be possible, however, to independently adjust different areas of the therapy device that relies on an inflatable bladder. Similarly, a therapy device that features a curved arc, for which the curve may be adjusted by tightening a base, may not allow for independent adjustment of different portions of the device.

Some currently available therapy devices may provide for a contour that may be adjusted by replacing parts of the device with other parts. For example, some therapy devices may provide pegs of various fixed lengths and may allow for the replacement of pegs. In this example, a user that desires a pressure member in a particular location to be higher relative to other pressure members may substitute a longer peg in place of a shorter peg. Such devices may not provide for fine tuning of the height of the pegs. Instead, the user may choose between the lengths of available pegs. In this example, if three peg heights are provided at 1", 2" and 3", then no heights between 1" and 2" nor 2" and 3" may be possible. In addition, such devices require that a peg is first detached, which may be inconvenient to a user. Furthermore, in a device that relies on pegs, the horizontal (x,y) position of a peg may be limited to the location of peg holes. In this case, fine horizontal (x,y) positioning in locations other than the available hole locations may not be possible.

Some currently available therapy devices may include hand-held devices with two pressure members for which the distance between the pressure members can be finely adjusted. For devices that allow for adjustment between the position of pressure members, however, it has remained a challenge to provide for adjustable heights of the pressure members.

Some currently available therapy device may pressure members that each have a screw attached, with each screw passing through a nut that is attached at an angled orientation to the edge of a base. For such a device, a pressure member and attached screw may be rotated through the nut to adjust the location of the pressure member along the orientation angle. As the height of the pressure member is decreased, for example, the end of the attached screw may move lower and may jut out of the base of the device. In this way, the height of the pressure member and the end position of the screw may be considered coupled. If so, the base may require a large minimum clearance height so that the bottom of the screw end does not touch the ground, or so that a possibly sharp edge of a screw may be exposed. To compensate, the screw may be oriented away from vertical. However, an orientation angle may introduce a coupling between the height of a pressure member and the relative distance between two pressure members. For example, any height change may entail a corresponding change in the relative horizontal distance between two pressure members. It may be desirable, however, for the heights and the relative horizontal distances between pressure members to be independently adjustable.

Improved Adjustable Therapy Devices for Body and Muscle Therapy

Certain aspects of the present disclosure overcome the limitations identified in the previous section. For example, unlike devices that may rely on an inflatable unit, certain aspects of the present disclosure enable a therapy device for which the adjustment of the height of a pressure member may be decoupled from the pressure (or rigidity) of the pressure member. Furthermore, for therapy devices with multiple pressure members, certain aspects of the present disclosure provide for independent adjustment of different areas of a therapy device.

In addition, certain aspects of the present disclosure enable a therapy device for which the adjustment of the height of a pressure member may be decoupled from the position of the end of an adjustable spacing unit. According to certain aspects, the end of an adjustable spacing unit may remain fixed while the height of a pressure member is increased or decreased. Based on certain aspects of the present disclosure, the height of a support base may be made smaller compared with a device that does not embody certain aspects of the present disclosure.

In addition, according to certain aspects, the distance between pressure members may be adjusted in a coordinated fashion, if desired, but the height of individual pressure members may still be adjusted independently.

Several embodiments of the present disclosure are presented in the next section to illustrate some of these advantages. According to certain aspects of the present disclosure, the height of one or more pressure members (which can be, for example, in the form of a firm ball) may be adjusted in the vertical direction in a fine manner relative to a support base. In addition, the height of one pressure member relative to that of another may be adjusted independently and in a fine manner. In addition, the relative distance between two or more pressure members in the horizontal plane may be adjusted. In addition, or alternatively, a pressure member may be arranged at an angle to a support base, including at a substantially perpendicular angle.

In some embodiments, adjustments may be accomplished without the time-consuming removal of a bolt or peg and subsequent replacement with a bolt or peg of a different length.

In some embodiments, the pressure member positions may be supported with a base such that the pressure members may be maintained in a certain position without being held manually (by the same person or by another person).

One embodiment may feature a single pressure member with a finely adjustable height and a support board. Another embodiment may feature a pair of pressure members each with a finely adjustable height and a finely adjustable horizontal distance between them and a support board. Another embodiment features a pair of angled pressure members each with a finely adjustable height and a finely adjustable horizontal distance between them and a support board In the next section we describe a number of exemplary embodiments. The first category involves embodiments with a single pressure member whose height can be adjusted relative to a support base. The second category involves embodiments with multiple pressure members whose height can vary finely and/or whose relative distance (horizontally) can vary finely along a single row. The third category involves embodiments with multiple pressure members whose height and/or relative distances (amongst themselves) can vary finely along two rows. It also includes embodiments with multiples pressure members whose height and/or relative distances (amongst themselves) can vary finely in more than two rows.

Single Pressure Member with an Adjustable Height

Some embodiments of the present disclosure may include a single pressure member whose height can vary with respect to a support base.

Figure 1B:
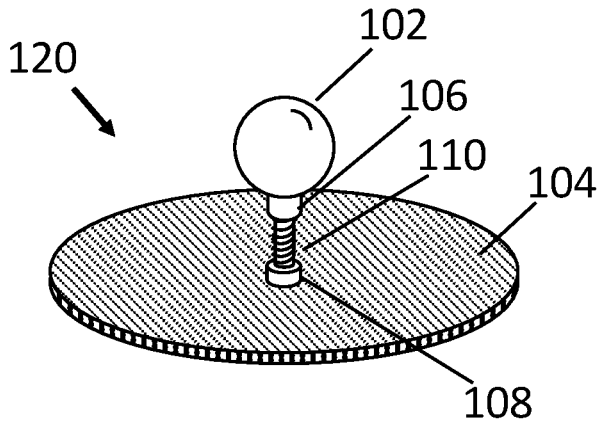
FIG. 1B illustrates a front perspective view of an example of an adjustable therapy device with a single pressure member in accordance with certain aspects of the present disclosure.

FIG. 1A and FIG. 1B illustrate an embodiment of certain aspects of the present disclosure. In the embodiment of FIG. 1A and FIG. 1B there is a single pressure member 102 whose height relative to a support base 104 may be finely adjusted. FIG. 1A illustrates a configuration 100 in which the height of the pressure member 102 relative to the base 104 is at a minimum. FIG. 1B illustrates a configuration 120 in which the height of the pressure member 102 is at a maximum. Height adjustment may involve rotating the pressure member clockwise (looking from above) to reduce the height (or distance) from the base to the pressure member, and vice versa to increase the height. In this example, the height may be adjusted by adjusting the height of an adjustable spacing unit which comprises a threaded male fastener 110, a threaded female fastener 106, and a nut 108.

In one mode of usage, this embodiment can be laid on a smooth ground surface such as a floor (wooden, tiled, carpeted) or massage bed and the user can position a particular area of the body, such as the under-arm area, on the pressure member. The ability to extend the height of the pressure member to reach the under arm area (which tends to be slightly raised compared to other parts of the body) may increase the effectiveness of this embodiment in comparison, for example, the use of a simple lacrosse ball without a means for height adjustment. Moreover, even though the rigidity of the pressure member may be maintained, the amount of pressure experienced by the user may be increased by increasing the height or decreased by decreasing the height by leveraging the body weight of the user.

Figure 1C:
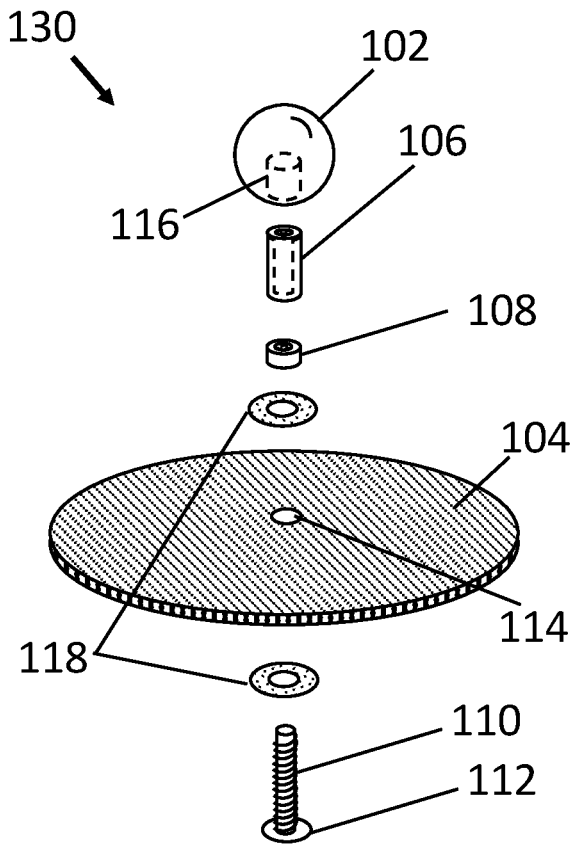
FIG. 1C illustrates an exploded, front perspective view of an example of an adjustable therapy device with a single pressure member in accordance with certain aspects of the present disclosure.

FIG. 1C illustrates an exploded view 130 of an embodiment similar to the one shown in FIG. 1A and FIG. 1B. In this example, a bolt head 112 is affixed to the male fastener 110 at the bottom end. The bolt head 112 may enable securement of the threaded male fastener 110 to the base 104 when the bolt head contacts the bottom surface of the base (bottom surface not visible) at an opening in the base 114, and the threaded male fastener passes through the opening 114. The embodiment shown in FIG. 1C includes optional washers 118, which are not included in the device shown in FIG. 1A and FIG. 1B.

In the exploded view 130, the threaded male fastener is aligned with the opening 114, but is not shown passing through the opening 114. In the minimum height configuration 100 illustrated in FIG. 1A, the threaded male fastener is in a secure configuration in which the threaded male fastener passes through the base 104 at an opening, but the threaded male fastener is not visible because the adjustable spacing unit is in a minimum height configuration. In the minimum height configuration, the threaded female fastener 106 may contact the nut 108, as shown in FIG. 1A. In the maximum height configuration 120 illustrated in FIG. 1B, the threaded male fastener is in a secure configuration in which the threaded male fastener 110 passes through the opening, and is visible. In the maximum height configuration shown in FIG. 1B, the threaded female fastener 106 is not in direct contact with the nut 108, and the threaded male fastener 110 portion of the adjustable spacing unit may be exposed.

In FIG. 1C the pressure member 102 is a sphere. The sphere may be constructed out of rubber whose diameter and/or hardness (referred to as "durometer") may be specified at a number of different values. The pressure member 102 has a cavity 116 which accepts the next component which may be referred to as an elongated threaded female fastener 106 which may be a long coupling nut. The pressure member 102 and the elongated threaded female fastener 106 may be fixed together at the cavity 116 such that a rotation of the pressure member 102 may entail a rotation of the threaded female fastener 106. During rotation of the pressure member 102 and threaded female fastener 106 that is attached at the cavity 116, the remaining components may remain fixed. These fixed components may include the threaded male fastener 110 which can be a long bolt which may have a head 112 for securing the threaded male fastener to the circular support base 104 via a nut 108. In this embodiment, an optional pair of washers 108 are shown, which may be included for added stability. In this embodiment, the distance between the pressure member 102 and the support base 104 may be finely adjusted by rotating the pressure member 102 and threaded female fastener 106 with respect to the threaded male fastener 110.

In addition, the elongated threaded female fastener 106 may be closed off at the end closer to the pressure member (e.g. may be a long coupling nut with one end closed off)—to prevent over-rotation. Over-rotation may result in the threaded male fastener forcing the pressure member away from the elongated threaded female fastener.

Other variants of the embodiment illustrated in FIG. 1A and FIG. 1B are also contemplated. For example, other shapes for the pressure member may be used, such as a hemisphere or blunt cone. Alternatively, or in addition, the nut forming a part of the lower fixed unit may have protrusions or a thread to allow easy tightening and grasping with fingers. For example, it can be a wing nut or larger cylindrical nut with patterns along the outer surface to allow for gripping. Other means for adjusting the height include having an outer cylinder and an inner cylinder and where the outer cylinder is tightened over the inner cylinder with a screw to lock the two together (as found in music stands and music speaker stands). The support base may take on different forms such as a rectangular shaped base with differing heights, a wall (e.g. where the screws are embedded into a wall) or any stable base. In one alternative, the threaded male fastener 110 may be embedded within the support base 104. In this alternative, the bolt head 112, washers 118, and nut 108 may not be required. These variants may also be applied to the following embodiments described below.

Figure 2A:
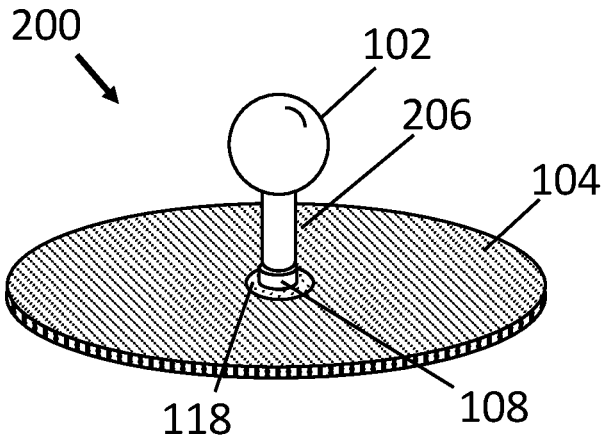
FIG. 2A illustrates a front perspective view of an example of an adjustable therapy device with a single pressure member in accordance with certain aspects of the present disclosure.
Figure 2B:
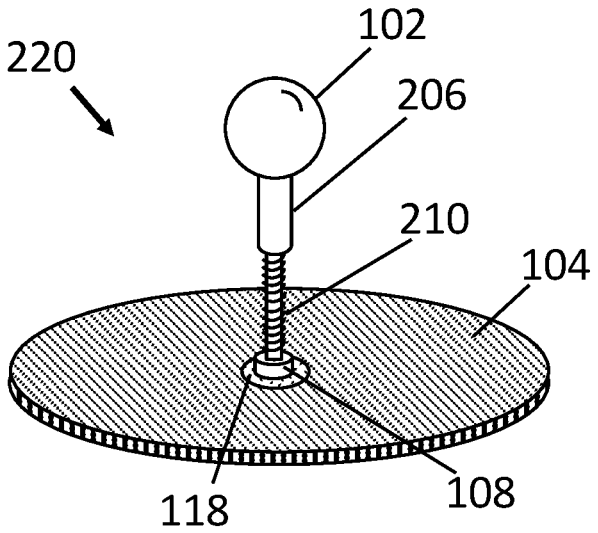
FIG. 2B illustrates a front perspective view of an example of an adjustable therapy device with a single pressure member in accordance with certain aspects of the present disclosure.

FIG. 2A and FIG. 2B illustrate an embodiment of certain aspects of the present disclosure that is similar to the embodiment shown in an exploded view in FIG. 1C as it contains a pressure member 102, a base 104, and optional washers 118. In FIG. 2A and FIG. 2B, the threaded female fastener 206 is longer than the corresponding threaded female fastener 106 shown in FIG. 1C. In addition, the threaded male fastener 210 of the embodiment shown in FIG. 2B is longer than the corresponding threaded male fastener 110 shown in FIG. 1C. The longer threaded male fastener 210 (in comparison to 110) may enable a larger range of adjustment for the height of the pressure member. For this embodiment, FIG. 2A and FIG. 2B show the minimum height configuration 200 and the maximum available height configuration 220, respectively, of the pressure member 102 with respect to the support base 104.

Figure 3A:
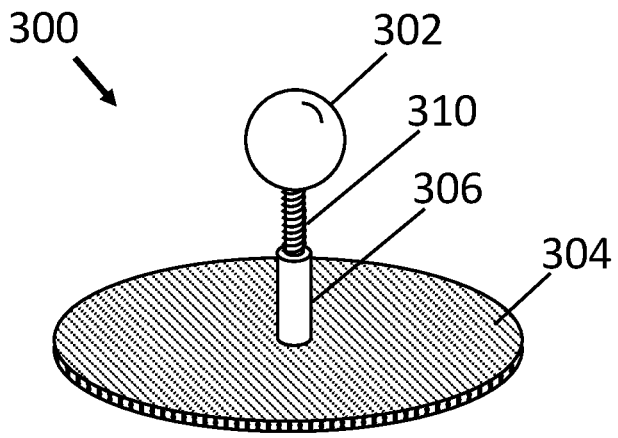
FIG. 3A illustrates a front perspective view of an example of an adjustable therapy device with a single pressure member in accordance with certain aspects of the present disclosure.
Figure 3B:
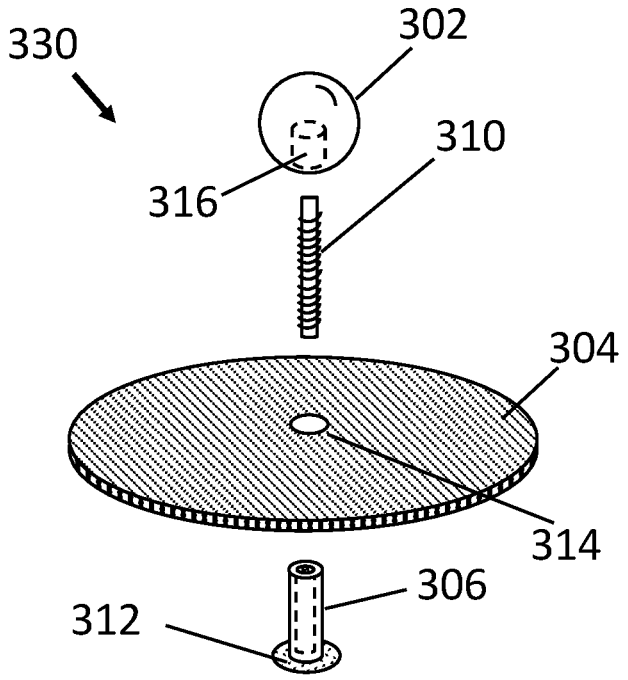
FIG. 3B illustrates an exploded, front perspective view of an example of an adjustable therapy device with a single pressure member in accordance with certain aspects of the present disclosure.

FIGS. 3A and 3B illustrate an embodiment of certain aspects of the present disclosure in which a threaded male fastener 310 is affixed to a pressure member 302 at a cavity 316 in the pressure member 302. An elongated threaded female fastener 306 such as a long coupling nut is affixed to the support base 304 such that a head 312 makes contact with a bottom surface of the base 304 and the threaded female fastener 306 passes through an opening 314 in the support base. A clockwise rotation (from above) of the pressure member 302 (which also rotates the threaded male fastener 310 that is affixed to the pressure member 302 at the cavity 316) may adjust the distance of the pressure member 302 to the support base 304 to which the threaded female fastener 306 is affixed or secured.

In one embodiment, a device in accordance with the present disclosure may include multiple lengths of threaded male fasteners and threaded female fasteners. A pair of male and female fasteners may be referred to as an adjustable spacing unit when configured in accordance with certain aspects of the present disclosure. By replacing a short adjustable spacing unit with a long adjustable spacing unit, the distance of a pressure member from the base may be adjusted in a coarse manner. In addition, because the adjustable spacing unit may be finely adjusted using rotation, the adjustable spacing units may enable fine adjustment of the distance of a pressure member to the base.

While FIGS. 1A-C, 2A-B, and 3A-B illustrate embodiments of certain aspects of the present disclosure with one pressure member and one base, other embodiments are also contemplated. For example, in one embodiment a first pressure member may have a female fastener affixed at a cavity as shown in FIGS. 1A-B and 2A-B, and a second pressure member may have a male fastener affixed at a cavity such as the cavity 316 shown in FIG. 3B. In this example, the threaded male fastener may be rotated with the threaded female fastener to adjust a distance between the first and second pressure members.

Figure 4A:
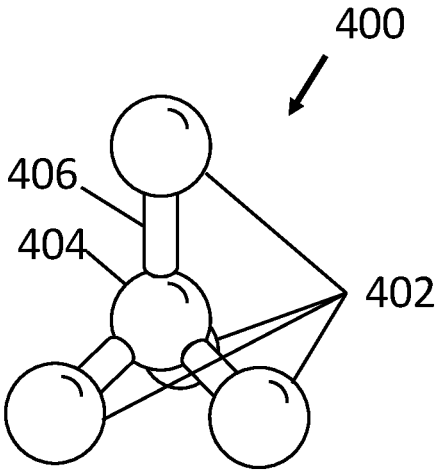
FIG. 4A illustrates a front perspective view of an example of an adjustable therapy device with four pressure members extending from a central hub in accordance with certain aspects of the present disclosure.
Figure 4B:
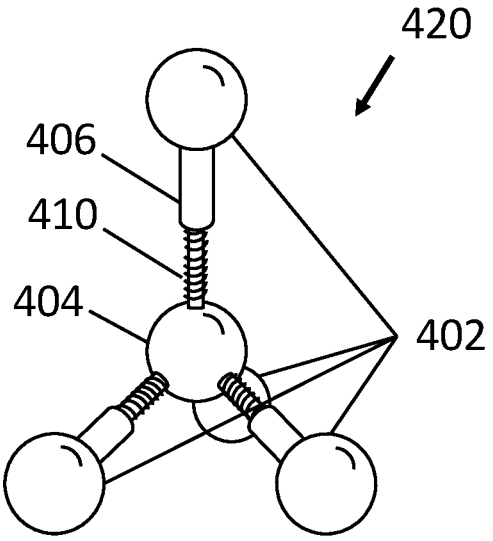
FIG. 4B illustrates a front perspective view of an example of an adjustable therapy device with four pressure members extending from a central hub in accordance with certain aspects of the present disclosure.

FIG. 4A and FIG. 4B illustrate an embodiment of certain aspects of the present disclosure with four pressure members 402 attached to a central hub 404. FIG. 4A shows the embodiment in a configuration 400 in which the distance of each pressure member 402 to the central hub 404 is at a minimal distance, which may correspond to the length of a threaded female fastener 406. FIG. 4B shows the embodiment in a configuration 420 in which the distance of each pressure member 402 to the central hub 404 is at a maximal distance. As shown in FIG. 4B, the central hub 404 may be connected to each pressure member by an adjustable spacing unit that includes a threaded male fastener 410 affixed to the central hub and a threaded female fastener 406 affixed to a pressure member. In this embodiment, four male fasteners may be attached to the central hub, and each threaded male fastener may be connected to a pressure member 402 via an elongated threaded female fastener 406. Each pair of threaded male fasteners and threaded female fasteners may an adjustable spacing unit. The adjustable spacing units may be rotated to vary the distance of the pressure member location to the central hub. In one use of this embodiment, three of the pressure members may be in contact with a flat surface such as a floor or a wall, and may serve as a support base from which the fourth pressure member distance (from the floor or wall) may be adjusted.

Multiple Pressure Members Along a Row with Adjustable Height and/or Relative Distances Some embodiments of the present disclosure may include a two or more pressure members. In some embodiments, the height of each pressure member and the distance between two pressure members may be adjusted finely along a single row. In some embodiments, the distance between two pressure members may be adjusted in a manner that is coarse in comparison to the fine adjustment of height of each pressure member.

Figure 5A:
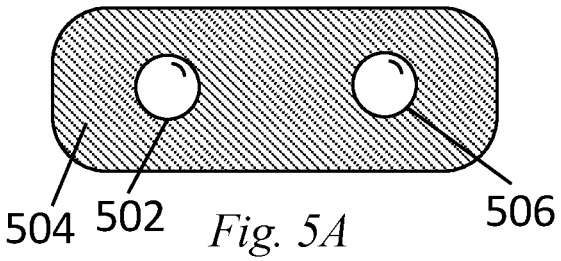
FIG. 5A illustrates a plan view of an example of an adjustable therapy device with two pressure members in accordance with certain aspects of the present disclosure.
Figure 5C:
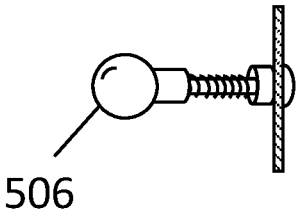
FIG. 5C illustrates a side elevation view of an example of an adjustable therapy device with two pressure members in accordance with certain aspects of the present disclosure.
Figure 5B:
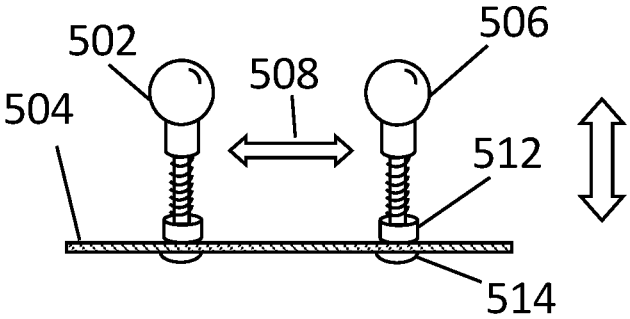
FIG. 5B illustrates a front elevation view of an example of an adjustable therapy device with two pressure members in accordance with certain aspects of the present disclosure.

FIG. 5A, FIG. 5B, and FIG. 5C illustrate an embodiment with two pressure members, a first pressure member 502 and a second pressure member 506, each connected to the base with an adjustable spacing unit, and for which the height of each pressure member relative to a support base 504 may be adjusted. In this embodiment, the horizontal distance 508 between the pressure members may be fixed. The horizontal distance may be determined by the spacing of two openings in the base through which the adjustable spacing units pass. In this embodiment, the adjustable spacing units may be secured to the base, for example, with a bolt head 514 and a nut 512. In an alternative embodiment, the adjustable spacing units may be affixed to the base without a bolt head 514 or nut 512 as shown. A user of this device may lay down on top of the device so that the pressure members are positioned to contact areas of the back such that the device may provide for relief. While the pressure members as shown are configured to have the same height, the first pressure member 502 may be configured at a first height and the second pressure member 506 may be configured at a second height, which may improve the therapeutic benefit of the device.

Figure 6A:
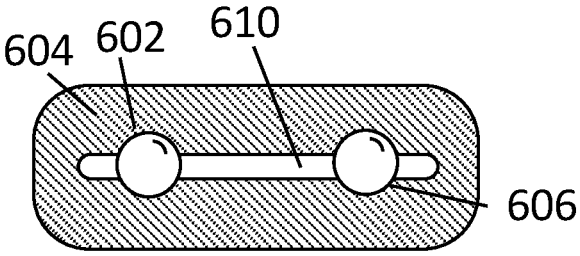
FIG. 6A illustrates a plan view an example of an adjustable therapy device with two pressure members in accordance with certain aspects of the present disclosure.
Figure 6C:
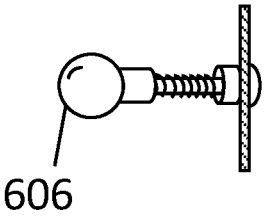
FIG. 6C illustrates a side elevation view of an example of an adjustable therapy device with two pressure members in accordance with certain aspects of the present disclosure.
Figure 6B:
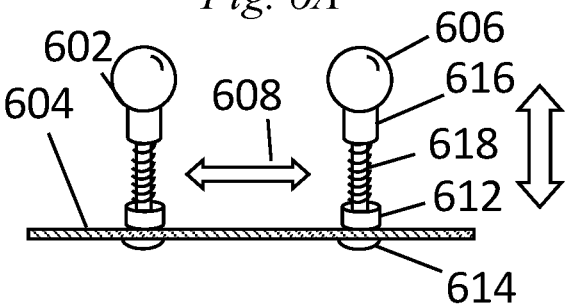
FIG. 6B illustrates a front elevation view of an example of an adjustable therapy device with two pressure members in accordance with certain aspects of the present disclosure.

FIG. 6A, FIG. 6B, and FIG. 6C illustrate an embodiment of certain aspects of the present disclosure. The embodiment in FIGS. 6A-C is similar to the embodiment illustrated in FIGS. 5A-C except that the base 604 in this embodiment has a substantially rectangular opening 610. In this example, a horizontal distance 608 between the first pressure member 602 and the second pressure member 606 may be adjusted. The horizontal distance may be the distance between the adjustable spacing units connected to each pressure member. In addition, the distance (or height) from each pressure member to the base 604 may be adjusted independently, without affecting the horizontal distance 608 between the first pressure member 602 and the second pressure member 606.

In this example, the adjustment of the horizontal distance may be accomplished by loosening a nut 612 which may be in contact with the support base 604, moving the bolt head 614 affixed to the threaded male fastener (including the washers (if any)) along the opening in the base 610 to a desired location, and then retightening the nut 612. If the female threaded fastener 616 and second pressure member 606 are connected to the male fastener 618 (as shown), then the combined adjustable spacing unit and pressure member 606 may be moved together. Alternatively, the female fastener 616 and second pressure member 606 may be removed and the second pressure member 606 may be repositioned by sliding the male fastener 618 to a desired location and then securing the male fastener 618 in place by tightening the nut 612.

Figure 7A:
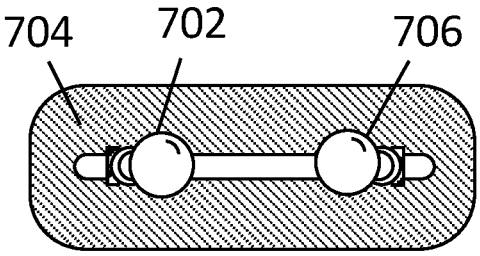
FIG. 7A illustrates a plan view of an example of an adjustable therapy device with two pressure members in accordance with certain aspects of the present disclosure.
Figure 7C:
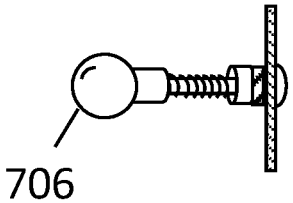
FIG. 7C illustrates a side elevation view of an example of an adjustable therapy device with two pressure members in accordance with certain aspects of the present disclosure.
Figure 7B:
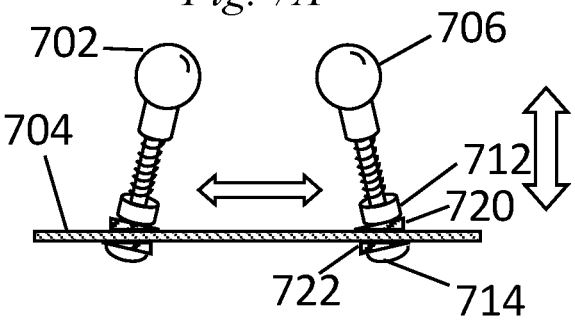
FIG. 7B illustrates a front elevation view of an example of an adjustable therapy device with two pressure members in accordance with certain aspects of the present disclosure.

FIG. 7A, FIG. 7B, and FIG. 7C illustrate an embodiment of certain aspects of the present disclosure. The embodiment in FIG. 7A-C is similar to the embodiment illustrated in FIGS. 6A-C except that the first pressure member 702 and the second pressure member 706 are angled. The angling of the second pressure member 706, for example, may be accomplished by inserting a first shim 720 between the base 704 and a nut 712. In this example, the shim may be may be a triangular wedge with an opening through which the adjustable spacing unit may pass. In addition, a second shim 722 may be inserted between the base 704 and the bolt head 714. The second shim 722 may be substantially the same as the first shim 720, and may be flipped upside-down and rotated 180 degrees relative to the first shim 722, as shown. The first shim 720 and the second shim 722 may be made of, for example, wood, metal or plastic. The angle may be adjusted by using a wedge of varying angles. This embodiment may be used for application of pressure at an angle (off the vertical-perpendicular to the support base). For example, it may be used for the back of the head at the occipital region.

Figure 8A:
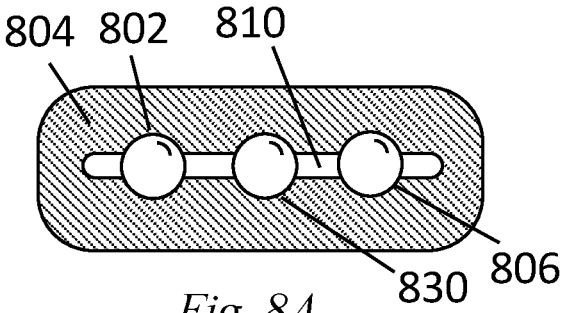
FIG. 8A illustrates a plan view of an example of an adjustable therapy device with three pressure members in accordance with certain aspects of the present disclosure.
Figure 8C:
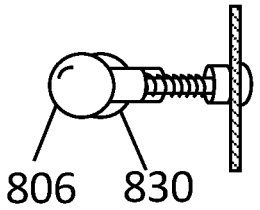
FIG. 8C illustrates a side elevation view of an example of an adjustable therapy device with three pressure members in accordance with certain aspects of the present disclosure.
Figure 8B:
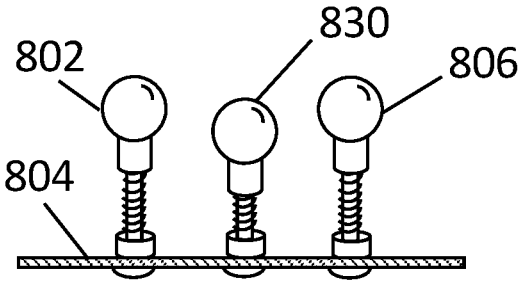
FIG. 8B illustrates a front elevation view of an example of an adjustable therapy device with three pressure members in accordance with certain aspects of the present disclosure.

FIG. 8A, FIG. 8B, and FIG. 8C illustrate an embodiment similar to that in FIGS. 6A-C except that it has three pressure members: a first pressure member 802, a second pressure member 806, and a third pressure member 830. The relative distances between each pressure member may be varied along the rectangular opening 810, which may be referred to as a slot. This embodiment may be used, for example, for a calf muscle. In this example, the center (or third) pressure member 830 which is configured at a lower height than the other pressure members, may apply most of the pressure to the calf muscle. In this example, the two side pressure members 802 and 806, which are configured at higher distances from the base 804, may help keep the calf and leg in place for stability. That is, the side pressure members 802 and 806 may prevent the leg from rolling off the center pressure member. Alternatively, or in addition, the side pressure members may prevent or lessen the user's deliberate tightening of the leg muscles in an effort to keep the leg in place. Such deliberate tightening may prevent relaxation and may lessen the effectiveness of the device in this use scenario. Embodiments with longer slots 810 are also contemplated. In addition, while this embodiment has three pressure members, embodiments with more pressure members are also contemplated. In addition, the slot need not be horizontal. Angled and/or curved slots are also contemplated.

Multiple Pressure Members Along Two or More Rows with Adjustable Height and/or Relative Distances Some embodiments of the present disclosure may include pressure members along two rows, the height of each pressure member and the relative distances between pressure members being adjustable. In some embodiments, the height of one or more of the pressure members may be adjustable while the height of one or more pressure members may be fixed. In some embodiments, the horizontal position of one or more pressure members may be adjustable while the horizontal position of one or more pressure members may be fixed.

Such embodiments may be positioned along the back and spine where a person would generally lay, such that a person could lay on top of the device. It would be helpful to those whose back tends to be arched forward (for example, due to extended sitting with the shoulder, neck and head arched forward, as may happen when people sit in front of a computer). In these scenarios and in other scenarios, an embodiment of certain aspects of the present disclosure may provide a means to help return the natural curvature of the spine and body posture.

Figure 9A:
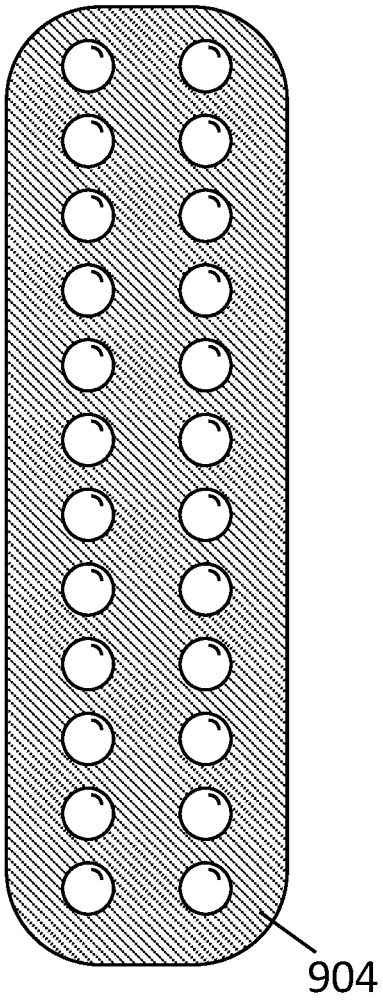
FIG. 9A illustrates a plan view of an example of an adjustable therapy device with two rows of pressure members in accordance with certain aspects of the present disclosure.
Figure 9B:
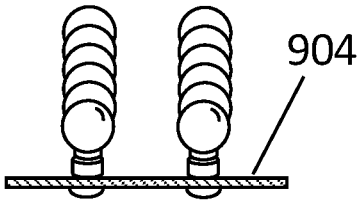
FIG. 9B illustrates a front elevation view of an example of an adjustable therapy device with two rows of pressure members in accordance with certain aspects of the present disclosure.
Figure 9C:
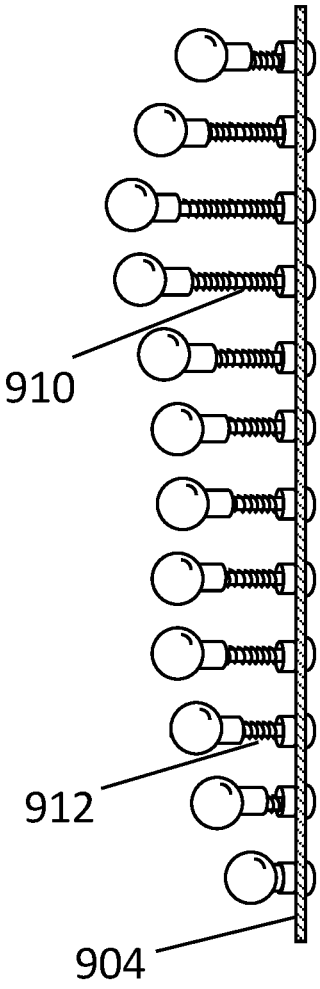
FIG. 9C illustrates a side elevation view of an example of an adjustable therapy device with two rows of pressure members in accordance with certain aspects of the present disclosure.

FIG. 9A, FIG. 9B, and FIG. 9C illustrate an embodiment of certain aspects of the present disclosure. In FIGS. 9A-C the horizontal positions of the pressure members (which may include the left/right position and the up/down position in the plan view (FIG. 9A)) are fixed. The heights of the pressure members may be adjusted using adjustable spacing units. This embodiment includes of an elongated rectangular support base 904 with holes in which the pressure member, bolts and nuts are affixed. The length of the support base and length of the rows may be set to the length of a person's back or spine. For example, the dimensions of the support base may be longer for an embodiment that is intended for an adult and may be shorter for an embodiment that is meant for a child. As can be seen in the side elevation view (FIG. 9C), the threaded male fasteners may have different lengths. For example, a first threaded male fastener 910 may be longer than a second threaded male fastener 912. The different lengths may be specified for coarse height settings of a device. The heights of the pressure members may then be adjusted for a particular person and/or application. The heights of the various pressure members illustrated in FIG. 9A-C represent one configuration for a device that may be used to help return the natural curvature of the spine and back posture.

Figure 10A:
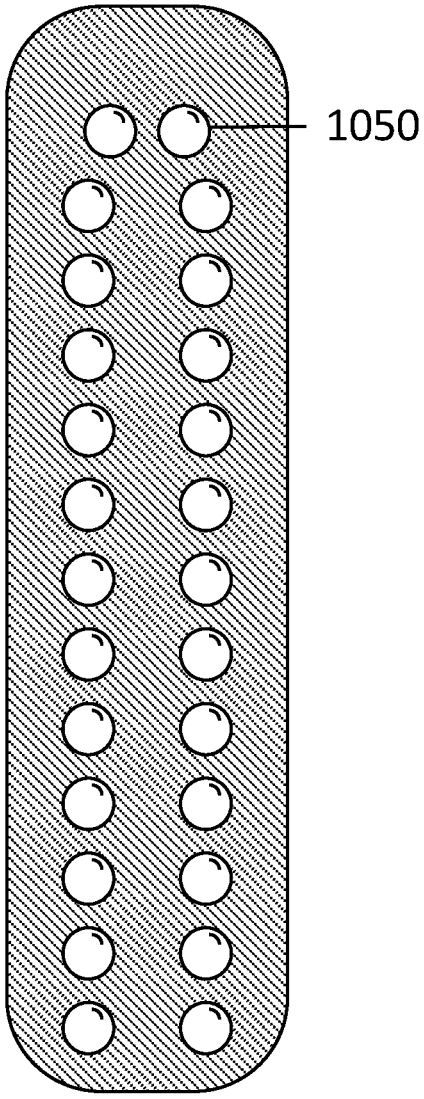
FIG. 10A illustrates a plan view of an example of an adjustable therapy device with two rows of pressure members in accordance with certain aspects of the present disclosure.
Figure 10B:
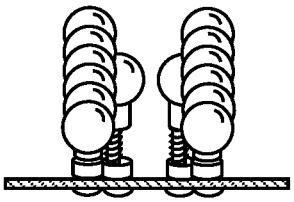
FIG. 10B illustrates a front elevation view of an example of an adjustable therapy device with two rows of pressure members in accordance with certain aspects of the present disclosure.
Figure 10C:
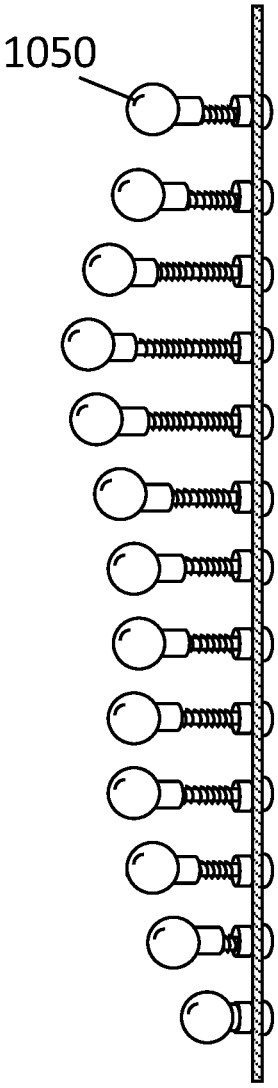
FIG. 10C illustrates a side elevation view of an example of an adjustable therapy device with two rows of pressure members in accordance with certain aspects of the present disclosure.

FIG. 10A, FIG. 10B, and FIG. 10C illustrate an embodiment similar to that in FIGS. 9A-C. The difference is the position of one row 1050 (the top row in the plan view (FIG. 10A)) of pressure members. The pressure members in row 1050 are located in a fixed location closer to each other than are the other pairs of pressure members in other rows. The closer pressure members in row 1050 may be applied, in one example, to the area just above of the neck—in the region of the occipital muscle. Alternate embodiments can adjust the fixed distance between the pair of pressure members in each row.

Figure 11A:
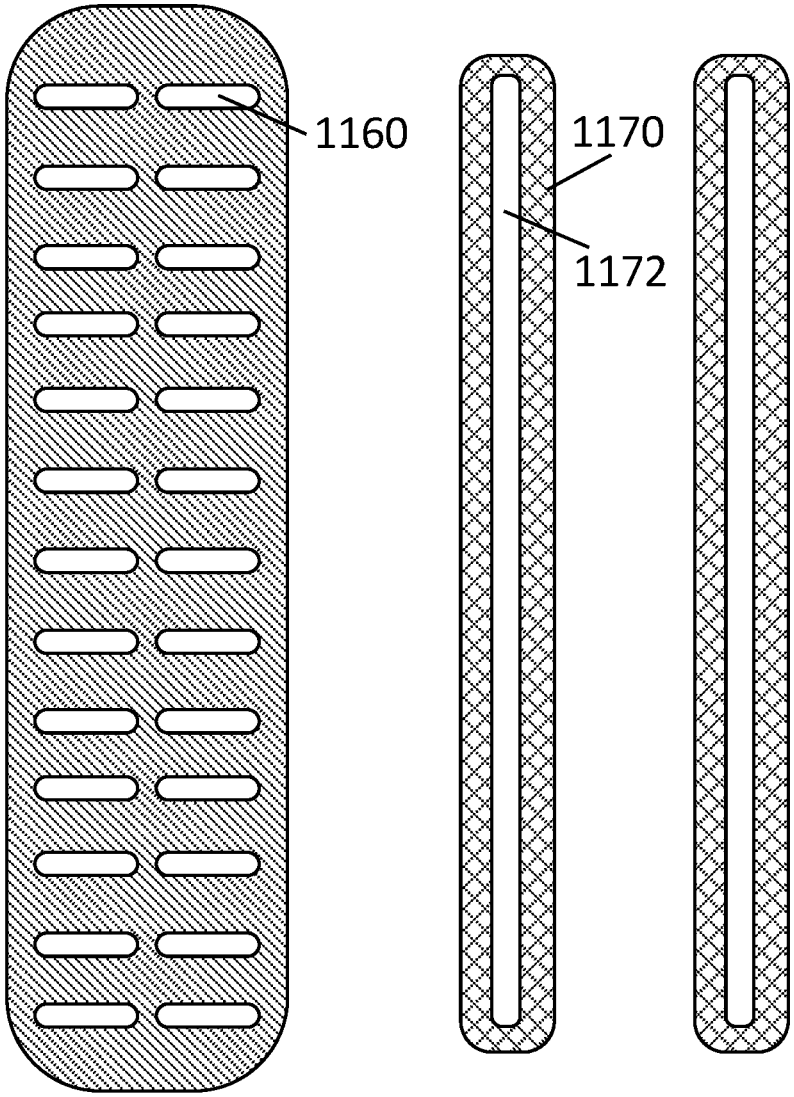
FIG. 11A illustrates a plan view of an example of an adjustable therapy device with two rows of pressure members in accordance with certain aspects of the present disclosure.
Figure 11B:
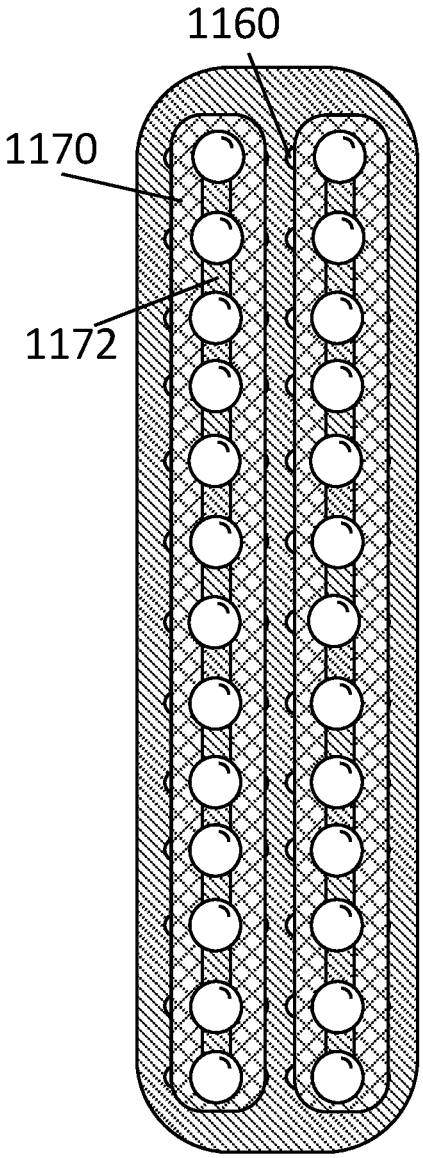
FIG. 11B illustrates a plan view of an example of an adjustable therapy device with two rows of pressure members in accordance with certain aspects of the present disclosure.

FIG. 11A illustrates an embodiment of certain aspects of the present disclosure that allows for fine adjustment of the pressure members along each row as well as for adjustment of their heights. Instead of the fixed holes (not visible) in the embodiments in FIGS. 9A-C and 10A-C, the embodiment in FIG. 11A has horizontal slots, for example the substantially rectangular opening 1160. An adjustable spacing unit attached to a pressure member may be inserted into one of the slots, moved to a desired location, and then secured in place by tightening its nut and bolt in place. Adjustment may be achieved by loosening the nut and moving the pressure member to an alternate location and then re-tightening. Optionally, two vertical pieces, for example the vertical piece 1170, that have vertical slots, such as the substantially rectangular opening 1172, may be used to align the pressure members along each of the two rows. An example configuration in which the vertical piece 1170 with a substantially rectangular opening 1172 is used to align pressure members in different rows, such as the row corresponding to the substantially horizontal slot 1160, is illustrated in FIG. 11B.

Figure 12A:
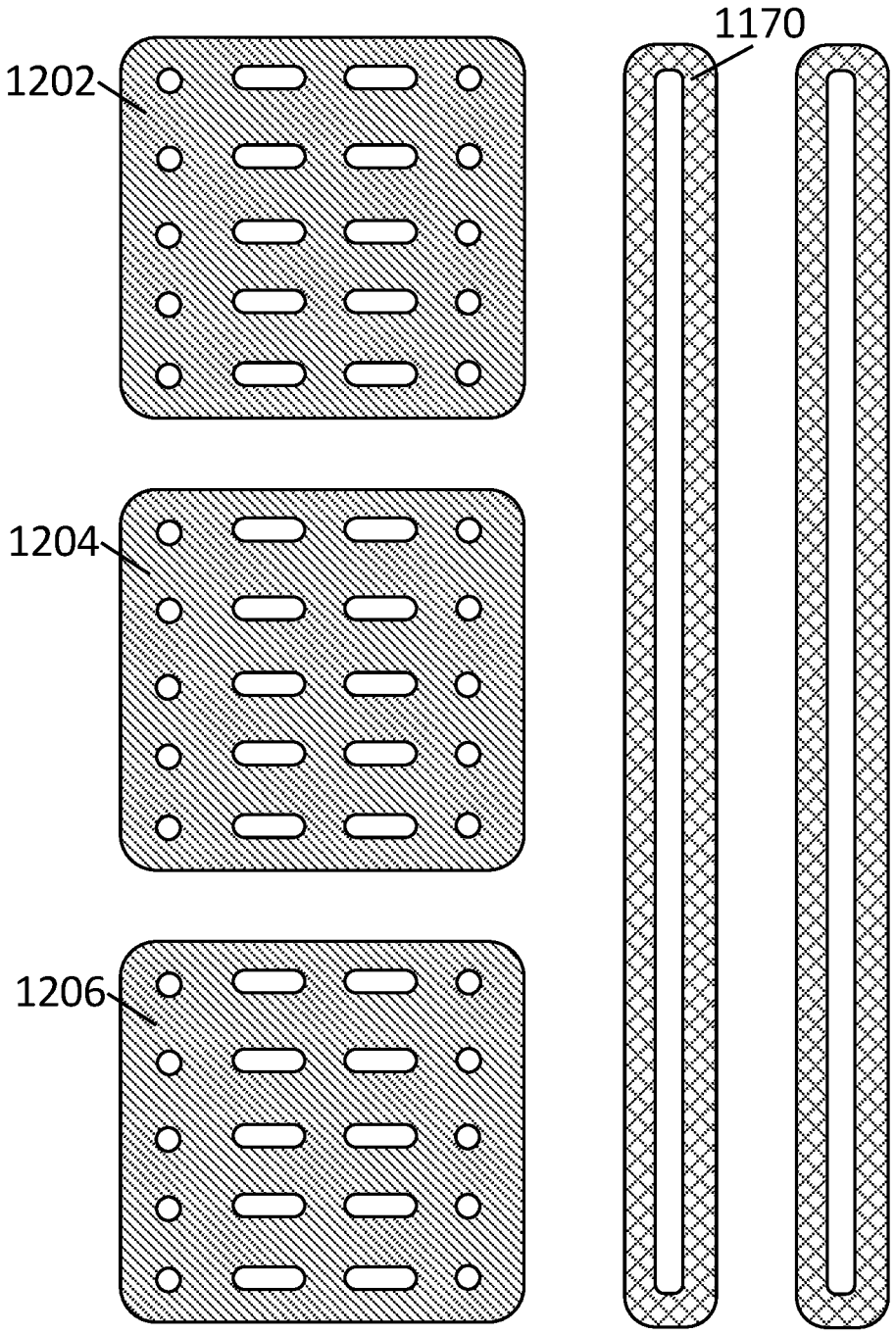
FIG. 12A illustrates a plan view of an example of an adjustable therapy device with four rows of pressure members in accordance with certain aspects of the present disclosure.

FIG. 12A illustrates an embodiment of certain aspects of the present disclosure in which pressure members may be grouped together using a base with multiple openings. In the example shown, there are three bases 1202, 1204, and 1206. These bases each have horizontal slots and circular openings. By using distinct bases, the position of a group of pressure members, such as pressure members connected to base 1202, may be adjusted in a fine manner relative to other pressure members or other groups of pressure members. For example, a user may adjust the distance between each group along the longitudinal direction (which may correspond to the direction of the spine). Still, using horizontal slots, the distance between two pressure members may be adjusted. In addition, using an adjustable spacing unit, the height of a pressure member may be adjusted.

Figure 12B:
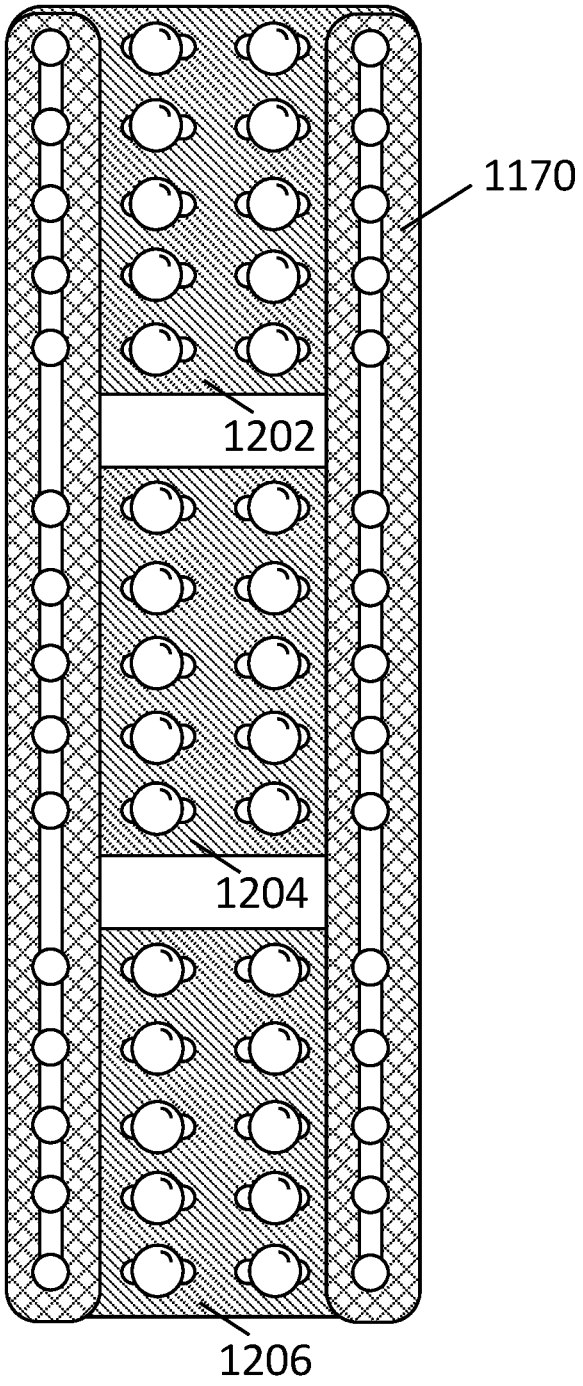
FIG. 12B illustrates a plan view of an example of an adjustable therapy device with four rows of pressure members in accordance with certain aspects of the present disclosure.

The embodiment illustrated in FIG. 12A and FIG. 12B depicts three groups: the bottom one 1206 may be applied to a lumbar region, the middle one 1204 may be applied to a thoracic region and the top one 1202 may be applied to the neck and head region. This embodiment may be used for people with differing back lengths. The two long pieces or rails (e.g. 1170) may be attached with screws to the three groups as depicted in the assembled embodiment of FIG. 12B. The relative distance between the three groups may be adjusted by loosening the screws (which may be nuts and bolt combinations) along the rails, moving one or more groups, and re-tightening the screws.

Figure 13A:
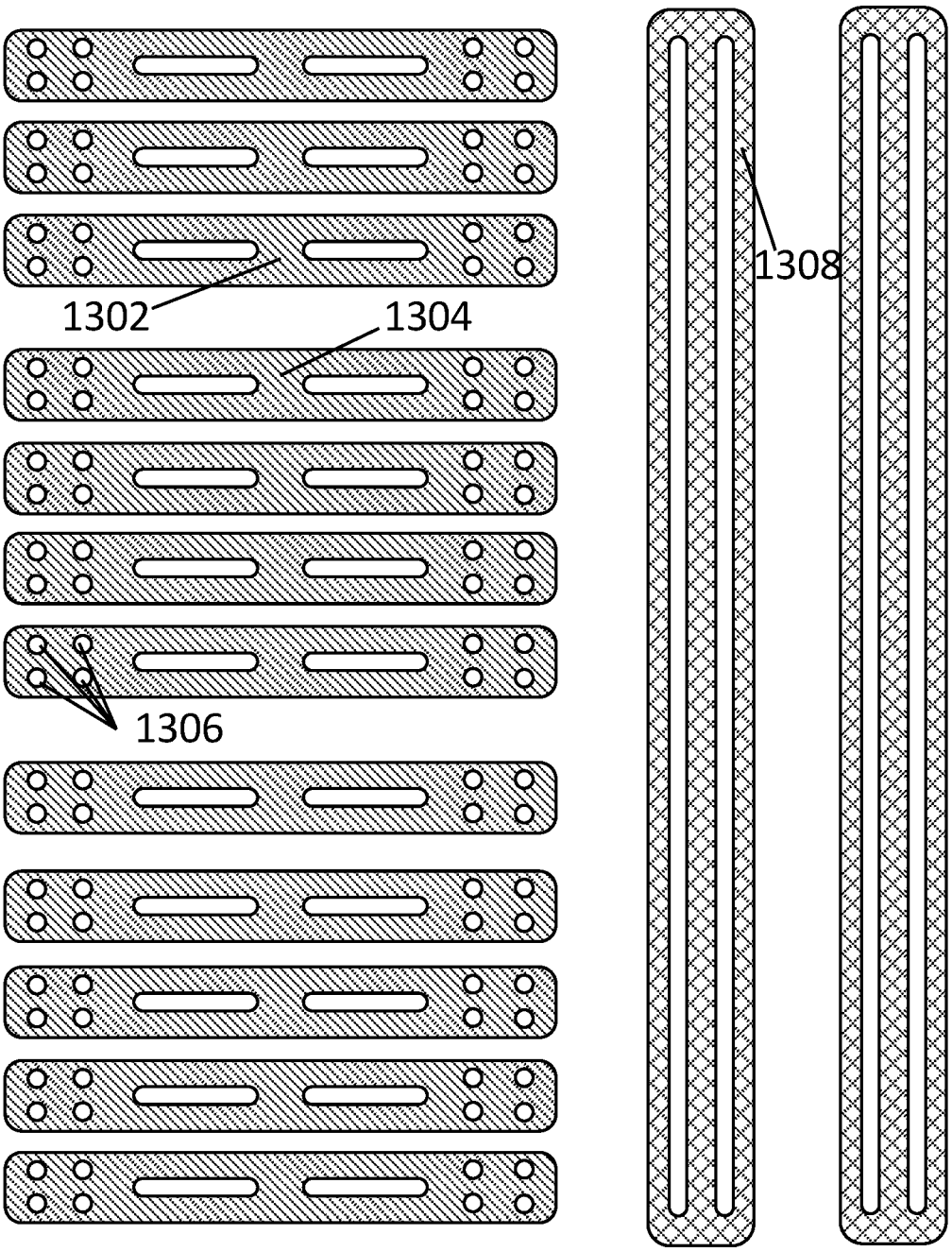
FIG. 13A illustrates a plan view of an example of an adjustable therapy device with six rows of pressure members in accordance with certain aspects of the present disclosure.
Figure 13B:
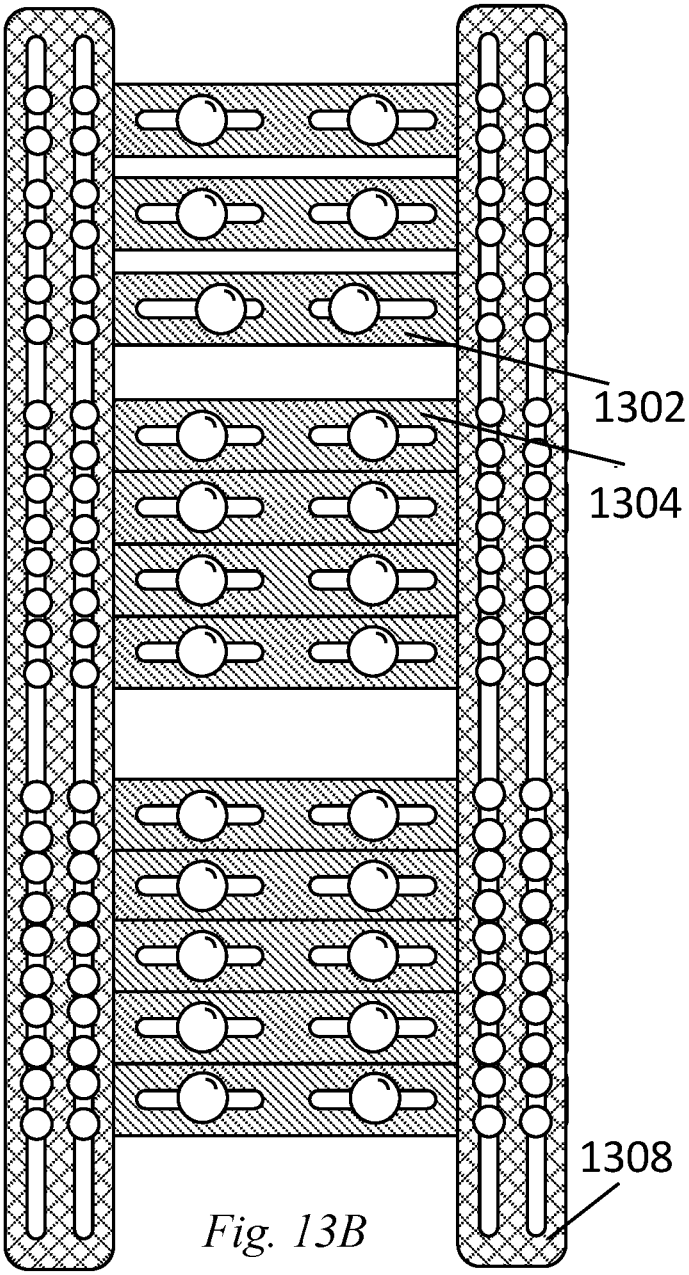
FIG. 13B illustrates a plan view of an example of an adjustable therapy device with six rows of pressure members in accordance with certain aspects of the present disclosure.
Figure 13C:
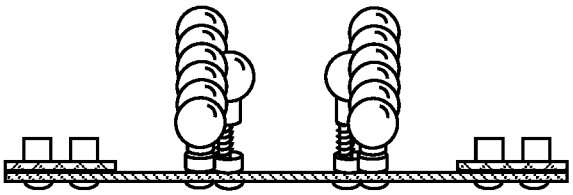
FIG. 13C illustrates a front elevation view of an example of an adjustable therapy device with six rows of pressure members in accordance with certain aspects of the present disclosure.
Figure 13D:
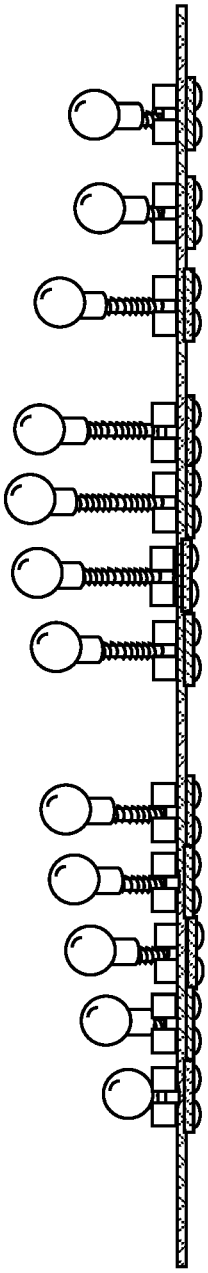
FIG. 13D illustrates a side elevation view of an example of an adjustable therapy device with six rows of pressure members in accordance with certain aspects of the present disclosure.
Figure 14A:
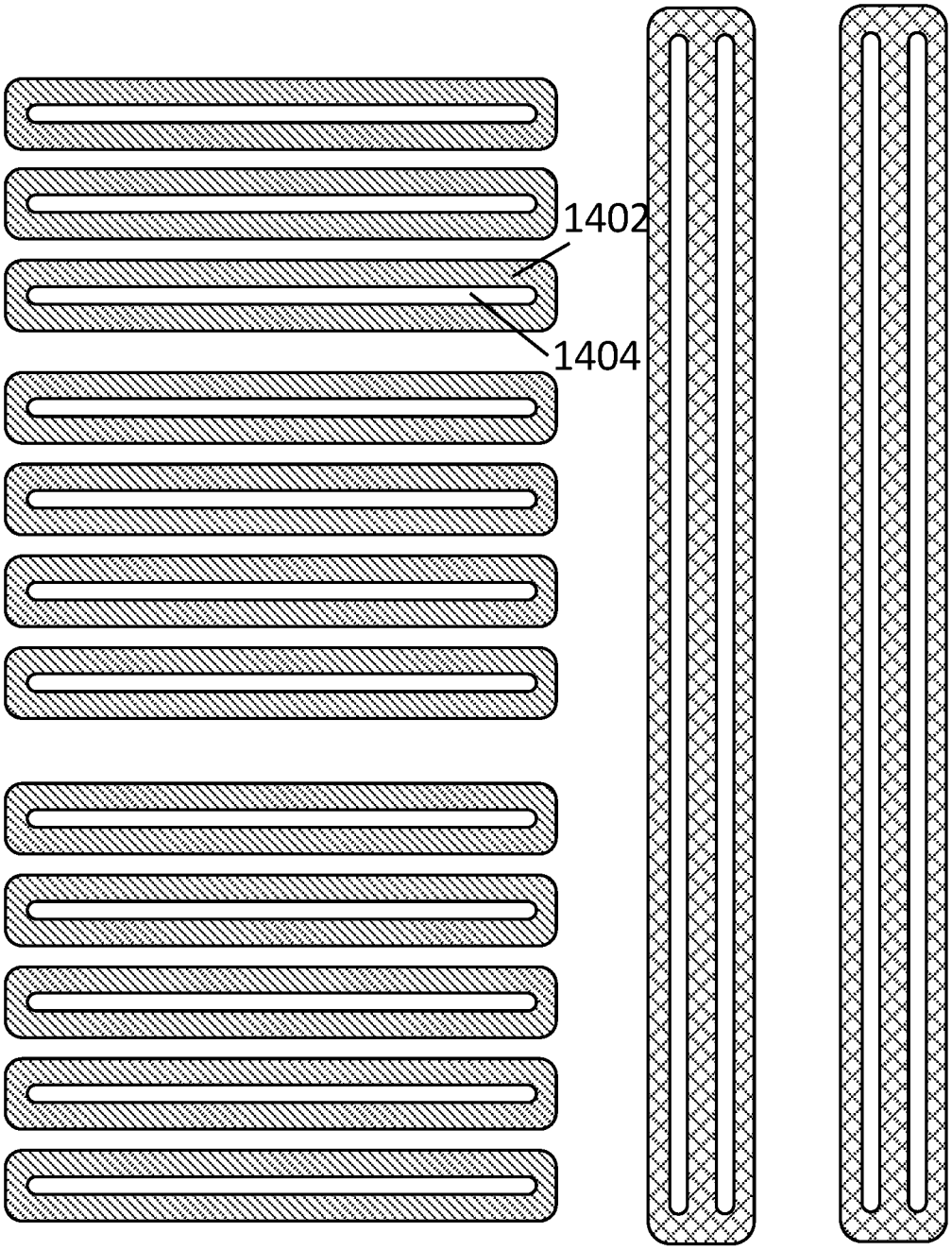
FIG. 14A illustrates a plan view of an example of an adjustable therapy device with six rows of pressure members in accordance with certain aspects of the present disclosure.
Figure 14B:
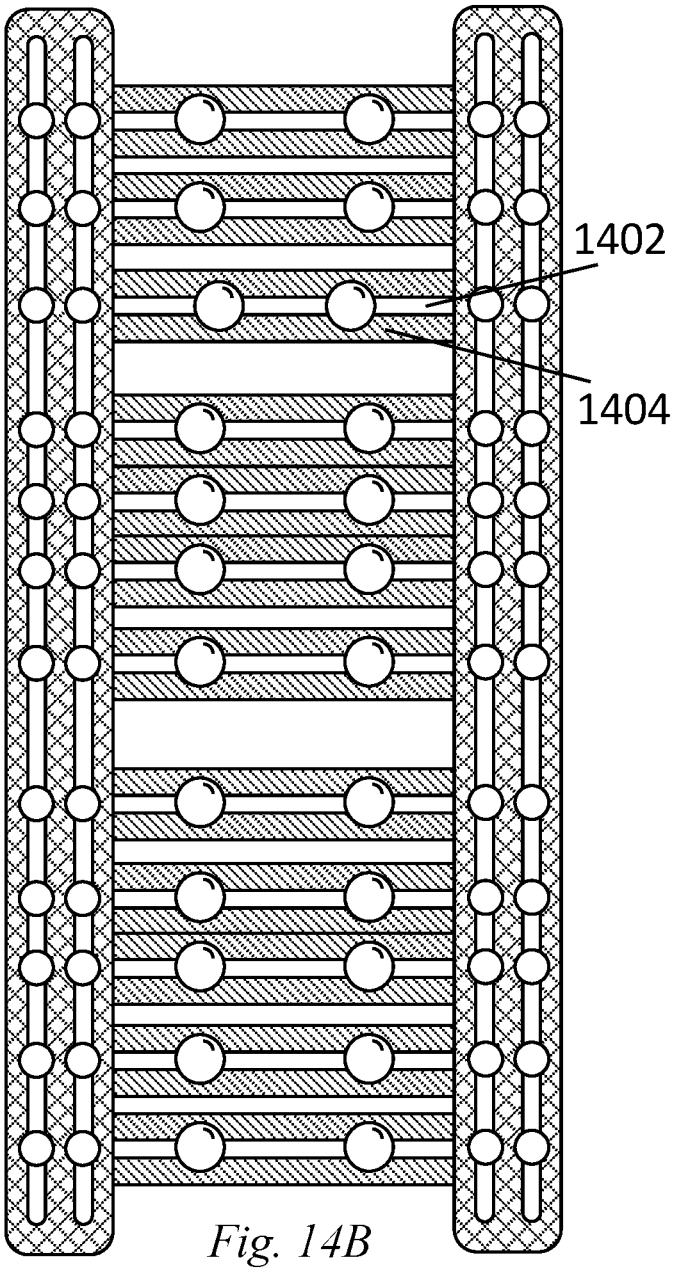
FIG. 14B illustrates a plan view of an example of an adjustable therapy device with six rows of pressure members in accordance with certain aspects of the present disclosure.
Figure 14C:
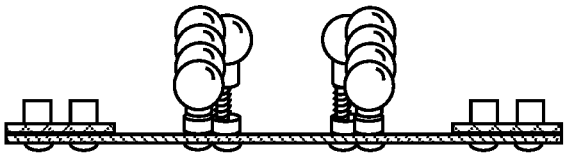
FIG. 14C illustrates a front elevation view of an example of an adjustable therapy device with six rows of pressure members in accordance with certain aspects of the present disclosure.
Figure 14D:
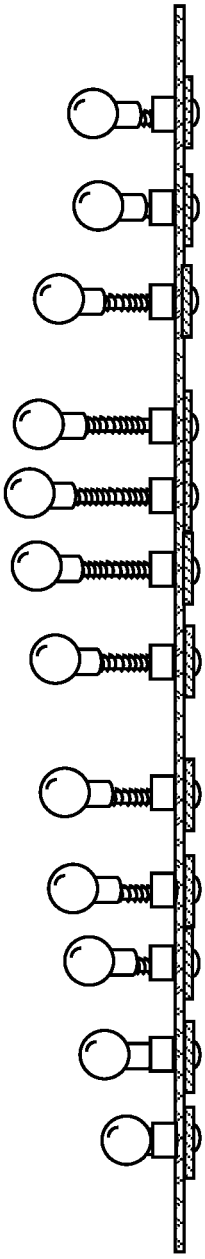
FIG. 14D illustrates a side elevation view of an example of an adjustable therapy device with six rows of pressure members in accordance with certain aspects of the present disclosure.

FIGS. 13A-D illustrate an embodiment of certain aspects of the present disclosure. In this example, pairs of pressure members may be grouped along each row. This grouping may be accomplished by a base that may be referred to as a row support. For example, the row support 1302 may support two pressure members, each being adjustable along the width of a horizontal slot. A second row support 1304 may support another two pressure members. A support base 1308 may include slots for multiple row supports, and may include two rails. Each row support may have two sets of holes. The holes along the edges, for example 1306, may be used for attachment with the rails. An adjustable spacing unit attached to a pressure member may be inserted between the edge holes 1306. Each rail may include two long slots for attaching each row support. An assembled configuration of this embodiment is depicted in FIG. 13B (plan view), FIG. 13C (front elevation view), and FIG. 13D (side elevation view). With this embodiment, the distance between each row support may be finely adjusted and more or less row supports may be used to accommodate different torso lengths of people and desired positioning of each row of pressure members. As with other embodiments, the pressure members may be adjusted finely in height and in the distance to other pressure members. An alternate embodiment may allow for additional pressure members (e.g. 3 or 4) per row support. Alternatively, or in addition, an embodiment may include a rail with only one long slot.

FIGS. 14A-D illustrate an embodiment of certain aspects of the present disclosure. The embodiment in FIGS. 14A-D is similar to that in FIGS. 13A-D, but the row supports (e.g. 1402) have a single long slot 1404 instead of edge holes and a two slots. This difference may be advantageous for manufacturing purposes and cost reduction. The slot in a row support may be used to insert adjustable spacing units attached to pressure members, and may connect the row support to the two rails as depicted in the assembled configuration illustrated in FIG. 14B (plan view), FIG. 14C (front elevation view), and FIG. 14D (side elevation view). As before, this enables an adjustment of distances between each row support, the distance between a pair of pressure members along each row, and the heights of a pressure member. Also as before, an alternative embodiment may allow for additional pressure members (e.g. 3 or 4) per row support or a rail with only one long slot.

Figure 15A:
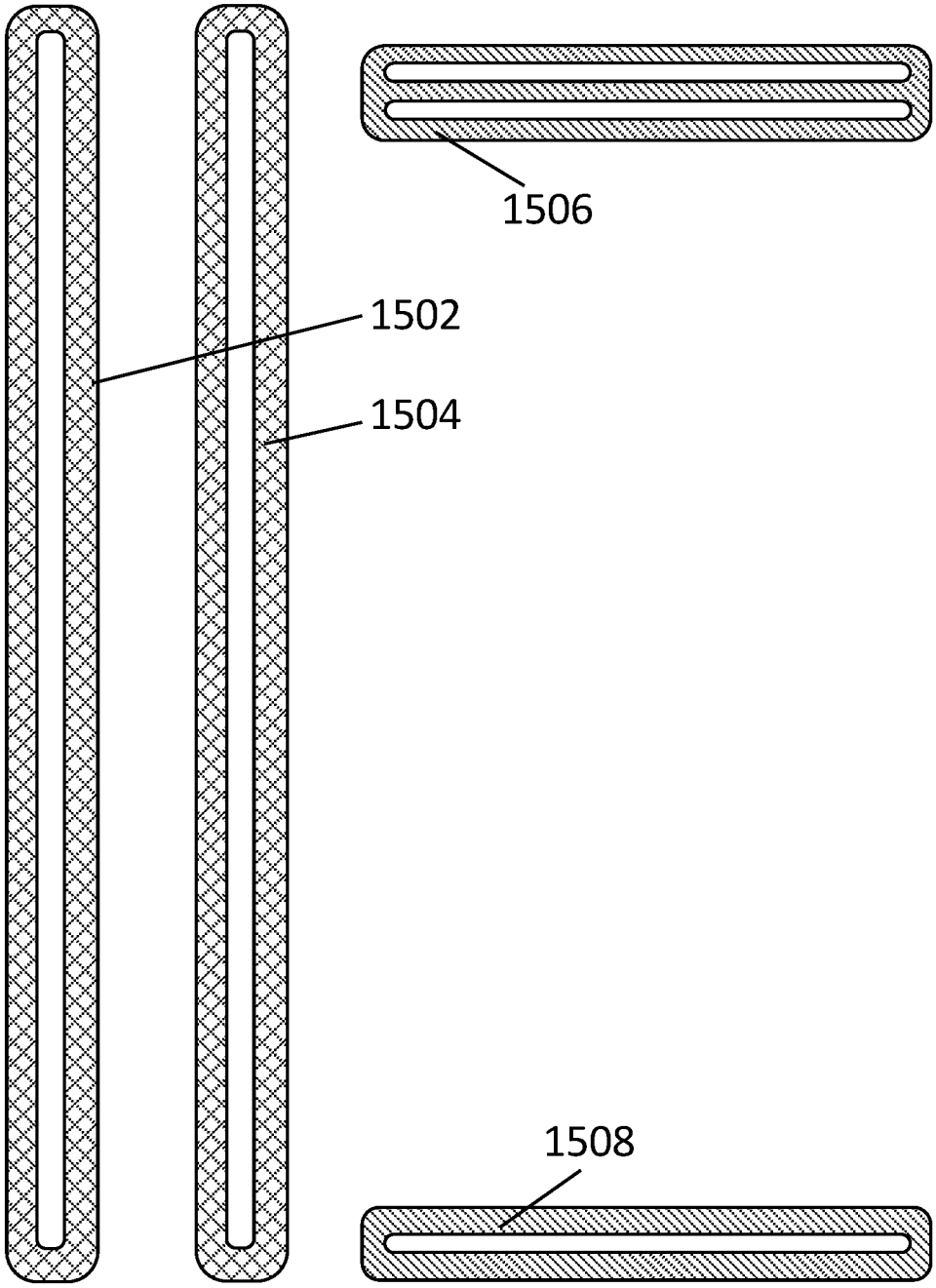
FIG. 15A illustrates a plan view of an example of an adjustable therapy device with two rows of pressure members in accordance with certain aspects of the present disclosure.
Figure 15B:
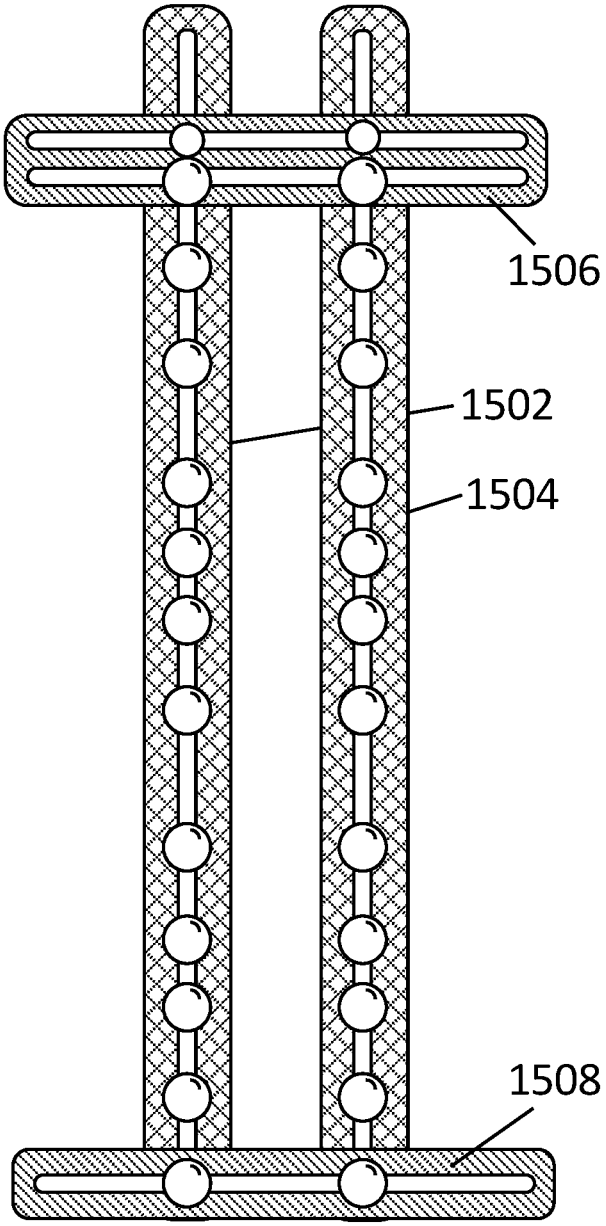
FIG. 15B illustrates a plan view of an example of an adjustable therapy device with two rows of pressure members in accordance with certain aspects of the present disclosure.
Figure 15D:
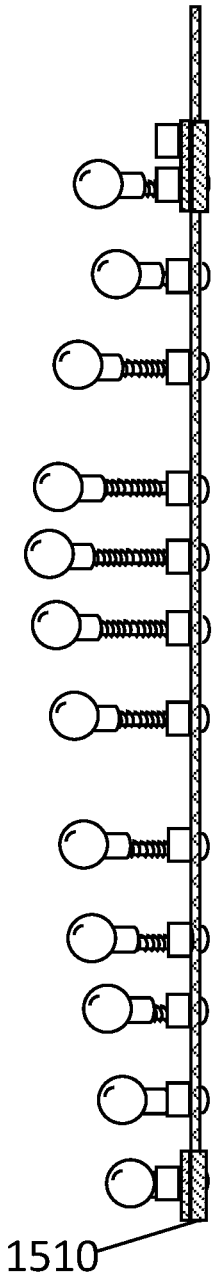
FIG. 15D illustrates a side elevation view of an example of an adjustable therapy device with two rows of pressure members in accordance with certain aspects of the present disclosure.
Figure 15C:
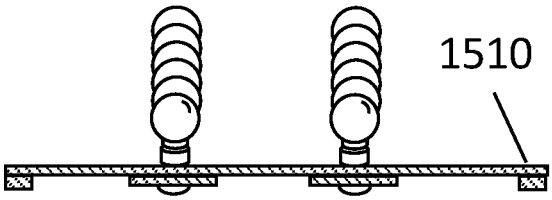
FIG. 15C illustrates a front elevation view of an example of an adjustable therapy device with two rows of pressure members in accordance with certain aspects of the present disclosure.

FIGS. 15A-G illustrate an embodiment of certain aspects of the present disclosure. This embodiment may be advantageous due to the amount of material required for each support base. It includes two long longitudinal bases 1502 and 1504 (shown vertically) and two connection bases 1506 and 1508 (shown horizontally). A connection base may have two slots to allow for a pair of fasteners to fasten with a longitudinal base (e.g. 1506). This may help maintain the longitudinal bases 1502 and 1504 in a position that is substantially perpendicular to the connection bases 1506 and 1508 as shown in the assembled configuration in FIG. 15B (plan view), FIG. 15C (front elevation view), and FIG. 15D (side elevation view). A connection base 1508 can also be outfitted with a protrusion 1510 at an end as shown in the bottom side view in FIG. 15B and right hand side view in FIGS. 15B-D. These protrusions may add stability to the device and may prevent wobbling. FIG. 15B shows one configuration where all the pressure members are aligned along each of the longitudinal bases. This configuration may allow for the pressure members to be distributed along the longitudinal axis with a spacing desired by the user. The closeness of the two longitudinal rows can be adjusted by adjusting the screws interfacing the two longitudinal bases 1502 and 1504 with the two connection bases 1506 and 1508.

Figure 15E:
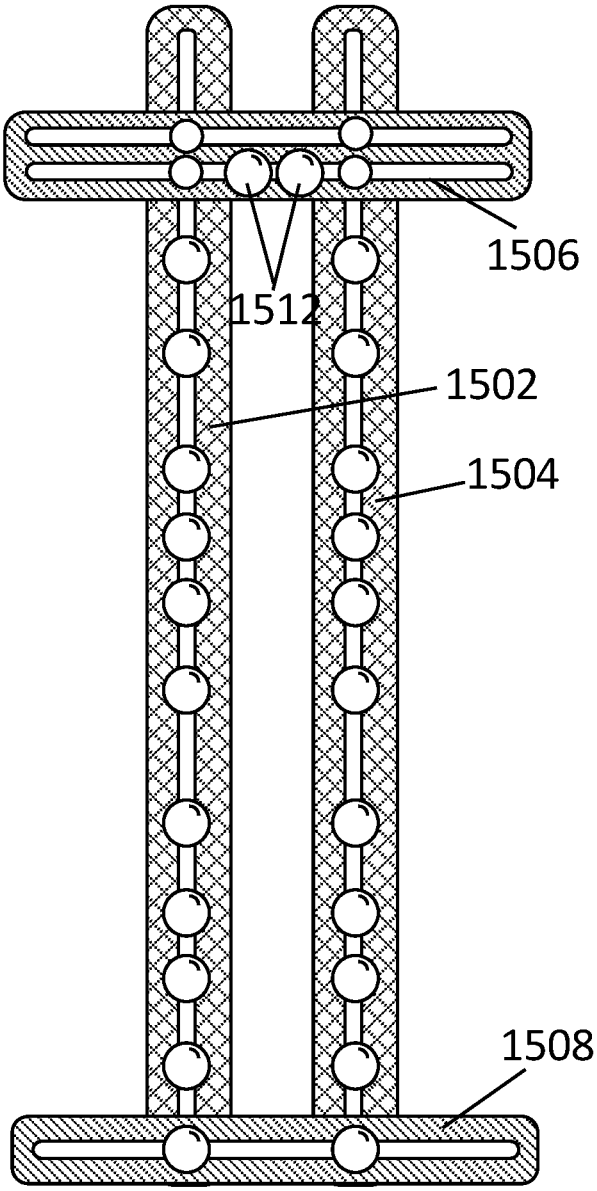
FIG. 15E illustrates a plan view of an example of an adjustable therapy device with two rows of pressure members in accordance with certain aspects of the present disclosure.
Figure 15F:
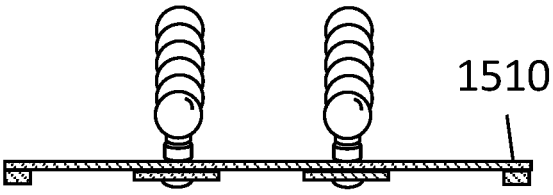
FIG. 15F illustrates a front elevation view of an example of an adjustable therapy device with two rows of pressure members in accordance with certain aspects of the present disclosure.
Figure 15G:
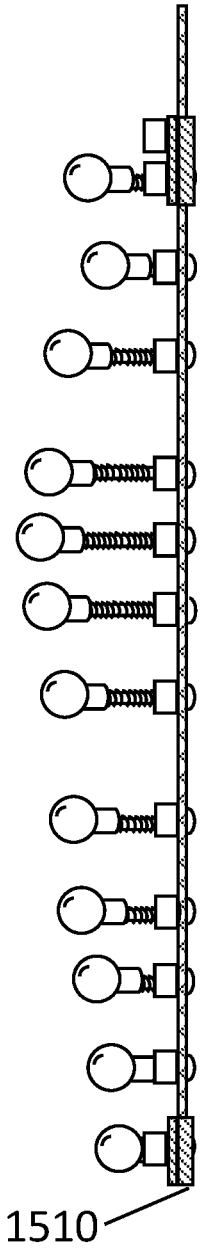
FIG. 15G illustrates a side elevation view of an example of an adjustable therapy device with two rows of pressure members in accordance with certain aspects of the present disclosure.

FIGS. 15E-G illustrate an alternative configuration in which one pair of pressure members 1512 is attached to the top connection base 1506. This allows for their application to the base of the neck or occipital muscle area. Additional connection bases may be added to serve as a handle (for example, at the top) if desired and/or for further stability of the device. In addition, non-parallel arrangements of the two longitudinal rails may be configured if, for example, a person wishes to have the pressure members closer at the base of the back and wider towards the shoulder or vice versa.

Some embodiments of the present disclosure may include pressure members along more than two rows, whose height and relative distance between them can be adjusted. Such embodiments may be configured as a bed of many pressure members whose heights can be adjusted.

Figure 16:
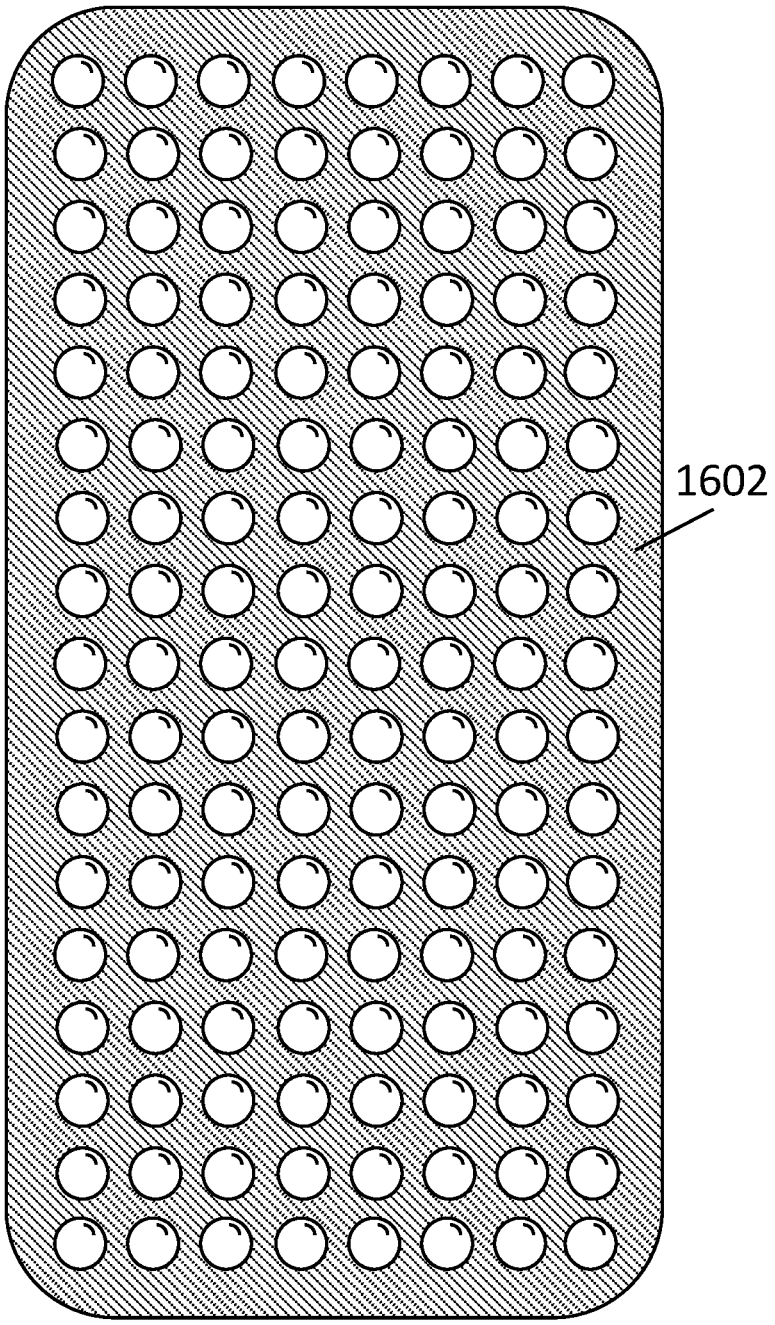
FIG. 16 illustrates an example of an adjustable therapy device with a bed of pressure members in accordance with certain aspects of the present disclosure.

FIG. 16 illustrates an embodiment with a bed of M×N pressure members. The pressure members may be arranged uniformly in fixed locations along M rows with N pressure members along each row. The support base 1602 may have a dimension that may support a full body and may be similar in dimensions to that of a mattress and/or bed. The support base 1602 may include M×N holes in which the adjustable spacing units may be inserted. The heights may be adjusted manually or with a remote control and motor mechanism.

Alternative Embodiments

While many of the Figures illustrate therapy devices with certain features (e.g. spherical pressure members), many alternative embodiments are also contemplated. While a pressure member may be a firm ball in an exemplary embodiment, the pressure members make have a variety of shapes. For example, the pressure members may be substantially a hemisphere, a cone, or a flat top which may have rounded edges, or a device may contain pressure members with a variety of shapes. Furthermore, the size and firmness of the pressure members may be varied. For example, spheres of varying size and firmness may be used.

Figure 17:
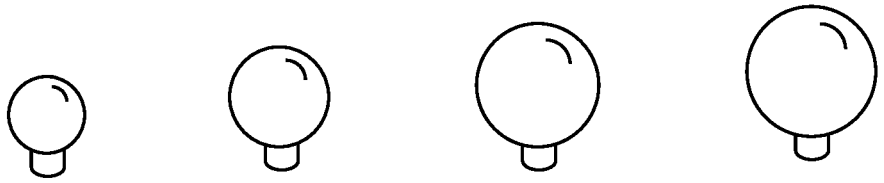
FIG. 17 illustrates an example of pressure members with varying diameters in accordance with certain aspects of the present disclosure.

FIG. 17 shows spherical pressure members of various diameters. In addition, a device for which pressure members of various firmness (durometer) are provided is also contemplated. For example, the firmness of provided pressure members may vary from very firm to very soft. In some embodiments, a color coding may be used for the pressure members. For example, different levels of firmness may be associated with a different color or pattern. In some embodiments, the pressure members may be made of different materials, such as rubber, plastic, wood, metal, or foam. In some embodiments, pressure members that are made of different materials may be provided.

While many of the embodiments illustrated in the Figures used the fine adjustment mechanism illustrated in FIG. 1C, other means for adjusting the distance from a base to a pressure member are contemplated. For example, the illustrated embodiments may have used the fine adjustment mechanism illustrated in FIG. 3B.

Figure 18:
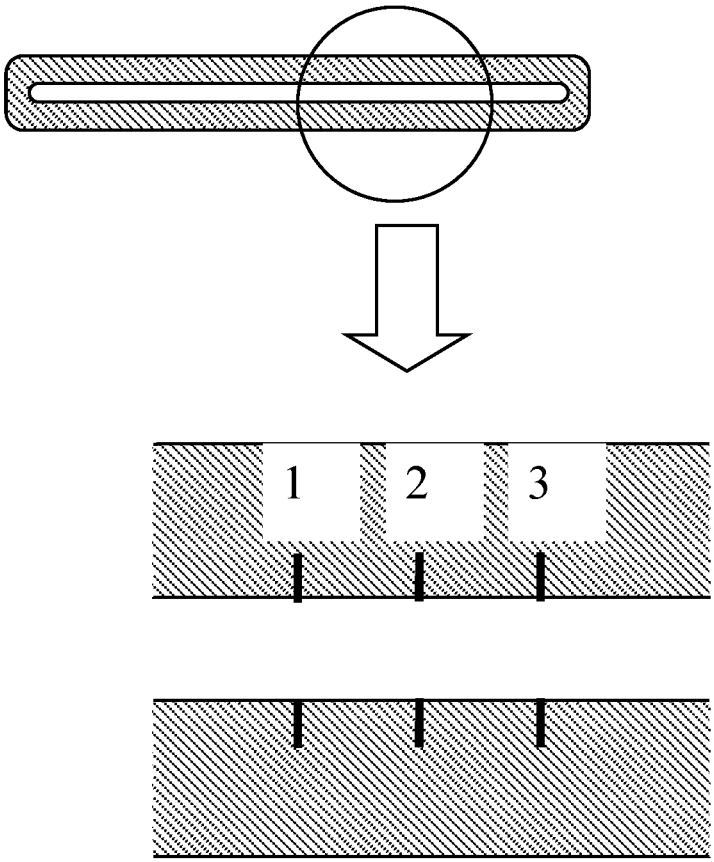
FIG. 18 illustrates an example of a support base with measurement markers in accordance with certain aspects of the present disclosure.

FIG. 18 illustrates markings 1, 2, and 3 along the slots in row supports and rails. In some embodiments, the addition of visual markers (such as tick marks, colors and/or length measurements of a ruler) may be used for positioning of the pressure members in the x,y,z directions. For example, slots and nuts may be marked with tick marks in units of cm or inches or half-inches.

Alternatively, or in addition, color coding may be added to adjustable spacing units. For example, the lower third of a bolt may have a first color, the middle third have a second color, and the top third of a third color. The divisions need not be equally spaced, and need not be limited to three colors as in this example. More or fewer colors are also contemplated.

In some embodiments, markers may be placed along the bolts attached to a pressure member. In some embodiments, a marker (e.g. red color) may be included to indicate that the pressure member is too high. For example, the top part of a screw may be colored red and, if exposed, would indicate that the pressure member is too high. This marking may indicate to the user that the pressure member has reached its maximum height beyond which the pressure member to bolt attachment may become weak and detach. In addition, a green color could indicate that the adjustment is within a safe range. Other markings are also contemplated. For example, small grooves may be added along a slot to help users identify default or typical locations of the pressure members.

In some embodiments, markers may be used to indicate a typical positioning for a person of a particular height or back length. In one example, yellow-colored markings on the support base can be used for a person with a height of 5' to 5' 6". Similarly, blue-colored markings on the support base can be used for a person with a height of 5' 6" to 6'. Such markings could be useful for creating an initial setting for users based on their height.

In some embodiments, a handle may be added for easy carrying of the device.

In some embodiments, multiple pressure members may be arranged in a column of two (or more) symmetric rows. Such embodiments may be used for treating the back including the spine. Alternatively, or in addition, embodiments may be used to treat the hips and/or neck. For example, pressure members may be arranged to conform to the length and shape of the spine of a person. In some embodiments, the coverage area may be extended to include the calves, legs, hips, neck and head. In one example, a bed of pressure members (e.g. with (x,y) dimensions of a twin bed) may support an entire body in which each member (or a portion of the members) may be adjusted in height. In a related example, a bed of pressure members may feature adjustable groups of pressure members in the (x,y) plane.

According to certain aspects, a remote control and motor mechanism for easy adjustment of the heights of each pressure member and/or their position in the horizontal plane.

In some embodiments, natural and/or synthetic materials, such as wood, metal, plastic or rubber, may be used for the base. In some embodiments, a non-sliding material such as rubber or neoprene can be affixed to the bottom of the support bases and screws to prevent the device from sliding and prevent scratching of sensitive surfaces such as hardwood floors.

As used herein, a phrase referring to "at least one of" a list of items refers to any combination of those items, including single members. As an example, "at least one of: a, b, or c" is intended to cover: a, b, c, a-b, a-c, b-c, and a-b-c.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the methods and apparatus described above without departing from the scope of the claims.

What is claimed is:

1. An adjustable therapy device comprising:

a base;

a plurality of pressure members, including a first and a second pressure member;

a plurality of adjustable spacing units, including a first and a second adjustable spacing unit; wherein the first adjustable spacing unit allows controlled adjustment of a first distance from a first surface of the base to the first pressure member; and wherein the second adjustable spacing unit allows controlled adjustment of a second distance from the first surface of the base to the second pressure member; and wherein each adjustable spacing unit of the plurality comprises a threaded male fastener rotatably attached to a threaded female fastener, the first adjustable spacing unit having a first end attached to the base and a second end attached to a cavity of the first pressure member, so that a rotation of the first pressure member with respect to the base causes an adjustment of the first distance from the first surface of the base to the first pressure member; and an opening in the base, wherein the opening is rectangular, the opening having a narrow span and a wide span, so that sliding the second adjustable spacing unit along the wide span of the opening causes an adjustment of a third distance from the first pressure member to the second pressure member.

2. The adjustable therapy device of claim 1, wherein the adjustment of the first distance caused by the rotation of the first pressure member with respect to the base is fine relative to the adjustment of the third distance caused by sliding the second adjustable spacing unit along the wide span of the opening.

3. The adjustable therapy device of claim 1, further comprising:

a nut fitted around the threaded male fastener; and a bolt head affixed to a first end of the threaded male fastener, the bolt head allowing for securement of the threaded male fastener to the base when the bolt head contacts a second surface of the base at the opening in the base and the threaded male fastener passes through the opening; wherein the narrow span of the opening is shorter than a span of the bolt head, and the wide span of the opening is longer than the span of the bolt head; the nut and the bolt head allowing securement of the male fastener to the base when tightened, and the nut and the bolt head allowing repositioning of the male fastener along the wide span of the opening when loosened.

4. The adjustable therapy device of claim 3, further comprising:

an angled shim, so that insertion of the angled shim between the first surface of the base and the nut, causes an angling of the second pressure member of the plurality of pressure members.

5. The adjustable therapy device of claim 1, further comprising:

a third and a fourth pressure member of the plurality of pressure members;

a third and a fourth adjustable spacing unit of the plurality of adjustable spacing units, the third adjustable spacing unit attached to the third pressure member, and the fourth adjustable spacing unit attached to the fourth pressure member; and a group spacing unit having a rectangular opening, the group spacing unit positioned between the base and the third and the fourth pressure members of the plurality of pressure members, allowing for a combined adjustment of a position of the third and the fourth pressure members with respect to the first pressure member.

6. The adjustable therapy device of claim 1, further comprising:

a marking for positioning of the first pressure member of the plurality of pressure members.

7. The adjustable therapy device of claim 1, further comprising:

a marking for positioning of the first adjustable spacing unit of the plurality of adjustable spacing units.

8. The adjustable therapy device of claim 1, wherein the first pressure member of the plurality of pressure members has a first shape and a first hardness;

wherein the second pressure member of the plurality of pressure members has a second shape and a second hardness; and wherein the first shape and the second shape are selected from the group of shapes consisting of a sphere, a hemisphere, and a cone.

* * * * *